US012723857B2

(12) United States Patent
Jeong

(10) Patent No.: US 12,723,857 B2
(45) Date of Patent: Sep. 1, 2026

(54) CHARGE SEPARATING APPARATUS

(71) Applicant: HANWHA AEROSPACE CO., LTD., Changwon-si (KR)

(72) Inventor: Hyun Seong Jeong, Changwon-si (KR)

(73) Assignee: HANWHA AEROSPACE CO., LTD., Changwon-si (KR)

( * ) Notice: Subject to any disclaimer, the term of this patent is extended or adjusted under 35 U.S.C. 154(b) by 0 days.

(21) Appl. No.: 19/268,174

(22) Filed: Jul. 14, 2025

(65) Prior Publication Data

US 2026/0185810 A1 Jul. 2, 2026

(30) Foreign Application Priority Data

Dec. 30, 2024 (KR) ..... 10-2024-0201199

(51) Int. Cl.

| | |
|---|---|
| ***F42B 39/10*** | (2006.01) |
| ***F41A 9/37*** | (2006.01) |
| ***F42B 39/08*** | (2006.01) |

(52) U.S. Cl.

CPC ..... *F42B 39/10* (2013.01); *F42B 39/082* (2013.01); *F41A 9/375* (2013.01)

(58) Field of Classification Search

None

See application file for complete search history.

(56) References Cited

U.S. PATENT DOCUMENTS 5,837,923 A * 11/1998 Gay ..... F41A 9/09 89/46
7,140,300 B2 * 11/2006 Minard ..... F41A 9/375 89/46

FOREIGN PATENT DOCUMENTS

| | | | |
|---|---|---|---|
| CN | 203229188 | U | 10/2013 |
| EP | 0498985 | A1 | 8/1992 |
| JP | 10 510217 | A | 10/1998 |
| WO | 96 30140 | A1 | 10/1996 |

OTHER PUBLICATIONS

DE 102011050282 B3 and English Translation (Year: 2012).*
DE 102011055045 A1 and English Translation (Year: 2013).*
FR 2945615 A1 and English Translation (Year: 2010).*
WO 2020187364 A1 and English Translation (Year: 2020).*

* cited by examiner

*Primary Examiner* — Reginald S Tillman, Jr.
(74) *Attorney, Agent, or Firm* — Sughrue Mion, PLLC

(57) ABSTRACT

A charge separating apparatus includes: a transporter configured to move charges in a supply direction; a door assembly configured to stop a front end of a unit of three charges at a predetermined position, the unit of three charges including a combination of a central charge, a front charge, and a rear charge; a gripper configured to grip each of the central charge, the front charge, and the rear charge; a separator configured to move the front charge in the supply direction and move the rear charge in a direction that is opposite to the supply direction; and a driver configured to supply driving power to the door assembly, the gripper, and the separator.

20 Claims, 17 Drawing Sheets

1

CHARGE SEPARATING APPARATUS

CROSS-REFERENCE TO RELATED APPLICATION

This application is based on and claims priority to Korean Patent Application No. 10-2024-0201199, filed on Dec. 30, 2024, in the Korean Intellectual Property Office, the disclosure of which is incorporated by reference herein in its entirety.

BACKGROUND

1. Field

The disclosure relates to a charge separating apparatus capable of automatically separating units of charges into separate charges.

2. Description of Related Art

For efficient loading and transfer of charges, an ammunition transport armored vehicle may load and transfer charges in the form of units of charges that combine a number of charges into one. In addition, for firepower equipment such as self-propellant artillery, charges may be supplied in the form of individual charges so that there is no limit to the number of charges combined according to range. In the related art, units of charges may be manually separated into three individual charges at the time of supplying charges. Separation of charges by manpower may hinder the speed and efficiency of supplying charges.

In addition, desensitized unit charges may be used to prevent explosions caused by external impacts by improving the tensile strength compared to existing charges.

The background technology described above is technical information that the inventor possessed or acquired during the process of deriving the disclosure and cannot necessarily be considered as publicly known technology disclosed to the general public prior to the application of the invention.

SUMMARY

Provided is a charge separating apparatus capable of automatically separating units of charges into separate charges.

Additional aspects will be set forth in the description which follows and, in part, will be apparent from the description, or may be learned by practice of the presented embodiments of the disclosure.

According to an aspect of the disclosure, a charge separating apparatus may include: a transporter configured to move charges in a supply direction; a door assembly configured to stop a front end of a unit of three charges at a predetermined position, the unit of three charges including a combination of a central charge, a front charge, and a rear charge; a gripper configured to grip each of the central charge, the front charge, and the rear charge; a separator configured to move the front charge in the supply direction and move the rear charge in a direction that is opposite to the supply direction; and a driver configured to supply driving power to the door assembly, the gripper, and the separator.

The driver may include: a first driving motor configured to supply driving power to the gripper; and a second driving motor configured to supply driving power to the door assembly and the separator.

The gripper may include: a center gripper configured to grip the central charge; a front gripper configured to grip the front charge; and a rear gripper configured to grip the rear charge, where the door assembly is connected to the front gripper and configured to receive driving power in a state in which the front gripper moves in the supply direction.

The door assembly may include: a rack gear fixed to a front end of the front gripper and extending in the supply direction; a pinion gear engaged with the rack gear; a door shaft fixed to the pinion gear and extending in a direction perpendicular to the supply direction; and a door fixed to the door shaft at an end of the door.

The separator may include: a power transmission separation gear configured to receive driving power from the driver; a front screw rod extending in the supply direction and fixed to the power transmission separation gear at an end of the front screw rod; a front nut connected to the front screw rod and fixed to the front gripper at an end of the front nut; and a guide rod penetrating the front gripper and extending parallel to the supply direction.

The separator may further include: a rear screw rod fixed to the power transmission separation gear at an end of the rear screw rod, the rear screw rod having a same central axis as the front screw rod and a screw direction that is opposite to a screw direction of the front screw rod; and a rear nut connected to the rear screw rod and fixed to the rear gripper at an end of the rear nut, where the guide rod penetrates the rear gripper.

The gripper may include: a first angle charge rod extending in the supply direction and configured to receive driving power from the driver; a second angle charge rod parallel to the first angle charge rod and spaced apart from the first angle charge rod by a predetermined distance; and a bevel gear rod engaged and connected to the first angle charge rod at a first end and the second angle charge rod at a second end, where the first angle charge rod and the second angle charge rod are configured to rotate in opposite directions.

The charge separating apparatus may further include a spacer remover configured to remove a spacer from the rear charge at a rear end of the unit of three charges.

The spacer remover may include: a coupling bar configured to rotate about a first end corresponding to a central axis; a spacer coupler at a second end of the coupling bar and configured to couple to the spacer; and a separation wall perpendicular to a rotation trajectory of the spacer coupler and including an opening through which the coupling bar may pass.

According to an aspect of the disclosure, a charge separating apparatus may include: a transporter configured to move charges in a supply direction; a door assembly configured to stop a front end of a unit of three charges at a predetermined position, the unit of three charges including a combination of a central charge, a front charge, and a rear charge; a gripper configured to grip each of the central charge, the front charge, and the rear charge; a separator configured to move the front charge in the supply direction and move the rear charge in a direction that is opposite to the supply direction; and a driver configured to supply driving power to the door assembly, the gripper, and the separator, where the driver includes: a first driving motor configured to supply driving power to the gripper; and a second driving motor configured to supply driving power to the door assembly and the separator.

The gripper may include: a first angle charge rod extending in the supply direction; a power transmission gripping gear fixed to the first angle charge rod and configured to receive driving power from the first driving motor; a power transmission bevel gear fixed to an end of the first angle charge rod; a second angle charge rod parallel to the first angle charge rod and spaced apart from the first angle charge rod by a predetermined distance; an angle change bevel gear fixed to an end of the second angle charge rod; and a bevel gear rod engaged with the power transmission bevel gear at a first end and engaged with the angle change bevel gear at a second end.

The gripper may include: a first gripping arm fixed to the first angle charge rod at an end of the first gripping arm; and a second gripping arm fixed to the second angle charge rod at an end of the second gripping arm, where the first gripping arm and the second gripping arm are configured to move closer to the central charge, the front charge, and the rear charge and away from the central charge, the front charge, and the rear charge based on a rotation of the first angle charge rod and the second angle charge rod.

The charge separating apparatus may further include a spacer remover configured to remove a spacer from the rear charge at a rear end of the unit of three charges.

In a state in which the first driving motor is driven in a first direction, the gripper may grip the central charge, the front charge, and the rear charge, and the spacer remover may move toward the spacer, where, in a state in which the first driving motor is driven in a direction that is opposite to the first direction, the gripper release a gripping of the central charge, the front charge, and the rear charge, and the spacer remover removes the spacer from the rear charge.

The spacer remover may include: a first removal shaft extending in a height direction; a second removal shaft parallel to the first removal shaft; a removal bevel gear fixed to an end of the first removal shaft and engaged with the power transmission bevel gear; a first spur gear fixed to the first removal shaft; a second spur gear fixed to the second removal shaft and engaged with the first spur gear; a coupling bar connected to the second removal shaft at a first end of the coupling bar; a spacer coupler arranged at a second end of the coupling bar and configured to be coupled to the spacer; and a separation wall perpendicular to a rotation trajectory of the spacer coupler and including an opening through which the coupling bar may pass.

The separator may include: a power transmission separation gear configured to receive driving power from the second driving motor; a front screw rod extending in the supply direction and fixed to the power transmission separation gear at an end of the front screw rod; a front nut connected to the front screw rod; and a guide rod extending parallel to the supply direction.

The gripper may further include a front gripper configured to grip the front charge, where the front gripper includes a front block configured to accommodate the first angle charge rod, the second angle charge rod, and the guide rod, and where the front nut is fixed to the front block.

The gripper further includes a central gripper configured to grip the central charge, and where the first driving motor and the second driving motor are fixed to the central gripper.

According to an aspect of the disclosure, a method performed by a charge separating apparatus including a transporter configured to move charges in a supply direction, a door assembly extending in a direction perpendicular to the supply direction, a gripper configured to grip charges, a separator configured to separate charges, and a driver configured to supply driving power to the door assembly, the gripper, and the separator, the method may include: moving, by the transporter, charges in a supply direction; stopping, by the door assembly, a front end of a unit of three charges at a predetermined position, the unit of three charges including a combination of a central charge, a front charge, and a rear charge; gripping, by the gripper, each of the central charge, the front charge, and the rear charge; and by the separator, moving the front charge in the supply direction and moving the rear charge in a direction that is opposite to the supply direction.

The charge separating apparatus further includes a spacer remover configured to remove a spacer, and the method may further include removing a spacer from the rear charge at a rear end of the unit of three charges.

BRIEF DESCRIPTION OF DRAWINGS

The above and other aspects, features, and advantages of certain embodiments of the disclosure will be more apparent from the following description taken in conjunction with the accompanying drawings, in which.

DETAILED DESCRIPTION

Figure 1:
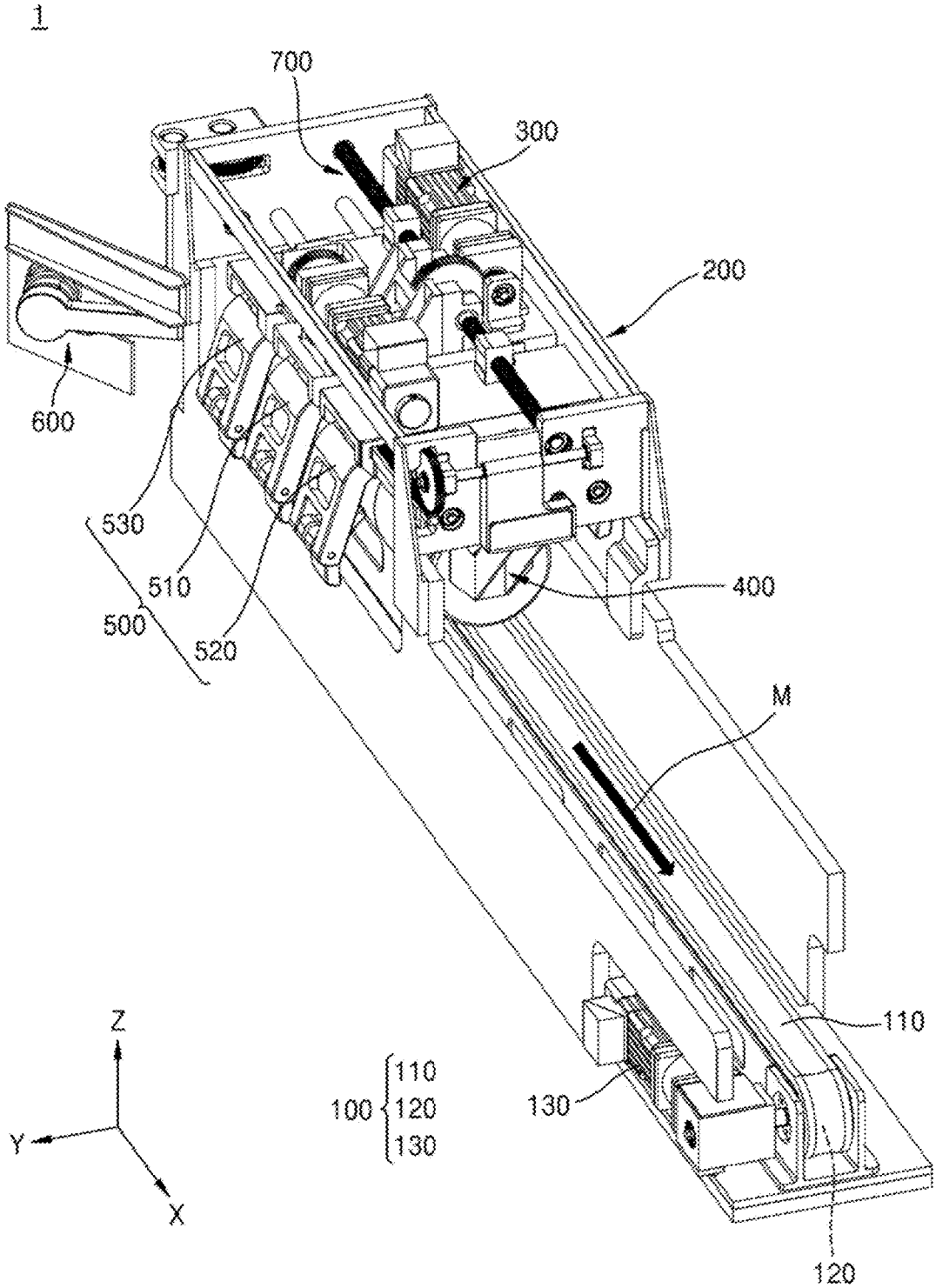
FIG. 1 is a perspective view illustrating a charge separating apparatus according to an embodiment.

Reference will now be made in detail to various embodiments, examples of which are illustrated in the accompanying drawings, wherein like reference numerals refer to like elements throughout. In this regard, the embodiments described are exemplary embodiments that may have different forms, and therefore, the disclosure should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Embodiments of the disclosure may be understood with reference to the description and drawings of the disclosure. The described embodiments have various modifications and may be implemented in different forms, and are not limited to the embodiments described herein. Furthermore, some or all of the features of each of the various embodiments of the present disclosure may be combined with each other. Each of the embodiments may be implemented independently of each other or in association with each other. The described embodiments are provided as examples to enable the present disclosure to be complete and perfect, and are intended to fully convey the idea of the present disclosure to those of ordinary skill in the art to which the present disclosure pertains. The present disclosure may be replaced within all modifications, equivalents, and the spirit and technical scope of the present disclosure. Thus, processes, components, techniques, and the like not required by one of ordinary skill in the art for a complete understanding of embodiments of the present disclosure may not be described.

Unless otherwise stated throughout the attached drawings and specifications, the same reference numerals, letters or combinations thereof indicate the same components, and thus redundant descriptions are omitted. In addition, in order to clearly explain the disclosure, units not related to the description are omitted.

The relative sizes of elements, layers, and areas in the drawings may be exaggerated for clarity. The use of hatching and/or shading in the accompanying drawings may generally be provided to clarify the boundaries between adjacent elements. Thus, the presence or absence of hatching or shading does not represent preferred forms or requirements for a particular material, material properties, dimensions, ratios, commonalities between illustrated elements and/or other characteristics, properties, features, etc. of an unspecified element.

Various embodiments are described herein with reference to cross-sectional examples that are schematic examples of embodiments and/or intermediate structures. Thus, for example, the shape of the drawing may vary as a result of manufacturing techniques and/or tolerances. Furthermore, the specific structural or functional description disclosed in this disclosure is merely an example for explaining an embodiment according to the concept of the present disclosure. Therefore, embodiments disclosed in the present disclosure should not be construed as being limited to the shape of the illustrated area, and include, for example, variations in the shape according to manufacturing.

The area shown in the drawing is essentially schematic and its shape is not intended to illustrate the actual shape of the device area and is not intended to be limited. In addition, as recognized by those skilled in the art, the described embodiments may be modified in various ways to the extent that they do not deviate from the spirit or scope of the present disclosure.

A number of specific details are presented to provide a complete understanding of various embodiments in the specification. However, various embodiments may be implemented without these specific details or including one or more details. In other cases, well-known structures and devices are shown in block diagram form to avoid unnecessarily obscuring various embodiments.

As illustrated in the drawing, spatially relative terms such as "down", "up", "lower unit", "upper unit", and the like may be used here to facilitate description of the relationship between one element or feature and another element or feature. The spatially relative terms are intended to include various directions of the device in use or operation in addition to the directions shown in the drawing. For example, if the device in the figures is turned over, elements described as "below," "beneath," "or "under" other elements or features would then be oriented "above" the other elements or features. Thus, as illustrative terms, "down" and "lower unit" may include both up and down directions. The device may be directed in a different direction (e.g., 90° rotation or another direction), and the spatially relative description used herein should be interpreted accordingly. Likewise, when it is stated that a first unit is positioned "above" a second unit, this means that the first unit is positioned above or below the second unit.

In addition, the expression "viewed from a plane" means the case where the object is viewed from above, and the expression "in an approximate cross-sectional view" means the case where the object is cut vertically or horizontally to take a rough cross-section. The term "as viewed from the side" means that the first object may be above, below, or on the side of the second object and vice versa. Additionally, the term "overlap" may include layer, stack, face or facing, extending over, covering, or partly covering or any other suitable term as would be appreciated and understood by those of ordinary skill in the art. The expression "non-overlapping" may include meanings such as "apart from" or "separated from" and any other suitable equivalents recognized and understood by one of ordinary skill in the art. The terms "face" and "surface" may mean that a first object may directly or indirectly face a second object. When there is a third object between the first object and the second object, it may be understood that the first object and the second object face each other but indirectly face each other.

It will be understood that when an element, layer, region, or component is referred to as being "formed on," "on," "connected to," or "(operatively or communicatively) coupled to" another element, layer, region, or component, it can be directly formed on, on, connected to, or coupled to the other element, layer, region, or component, or indirectly formed on, on, connected to, or coupled to the other element, layer, region, or component such that one or more intervening elements, layers, regions, or components may be present. In addition, "formed in", "connected to", or "combined with" may collectively refer to an integral or non-unitary combination or connection with a direct or indirect combination or connection of an element, layer, region, or component so that one or more elements, layers, regions, or components may exist. For example, when a layer, region, or component is referred to as being "electrically connected" or "electrically coupled" to another layer, region, or component, it can be directly electrically connected or coupled to the other layer, region, and/or component or intervening layers, regions, or components may be present. However, "directly connected to" or "directly combined with" means that one component is connected to or combined with another directly without an intermediate component, or the former is on the latter. In addition, in the present disclosure, when a unit of a layer, film, region, guide plate, etc. is formed on another unit, the formation direction is not limited to the upper direction, and includes the unit being formed on the side or bottom. Conversely, when a unit of a layer, film, region, guide plate, etc. is formed "underneath" another unit, this includes not only the case where the unit is "directly under" the other unit, but also the case where there is still another unit between the unit and the other unit. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

For the purposes of the present disclosure, expressions such as "at least one" or "any one" do not limit the order of individual elements. For example, "at least one of X, Y or Z", "at least one of X, Y or Z", "at least one selected from a group of X, Y and Z" may include X alone, Y alone, Z alone, and any combination of two or more of X, Y and Z. Similarly, expressions such as "at least one of A and B" and "at least one of A or B" may include A, B, or A and B. In the present disclosure, the term "and/or" generally includes all combinations of one or more related list items. For example, expressions such as "A and/or B" may include A, B, or both A and B.

Although the terms "first," "second," "third," etc. may be used herein to describe various elements, components, regions, layers, and/or cross-sections, such elements, components, regions, layers, and/or cross-sections are not limited by these terms. These terms are used to distinguish one element, component, region, layer or cross section from another element, component, region, layer or cross section. Therefore, the first element, component, region, layer or cross section described below may be referred to as the second element, component, region, layer or cross section without departing from the spirit and scope of the present disclosure. The description of an element as a "first" element may not require or imply the presence of a second element or other elements. Terms such as "first", "second", and the like may be used in the present disclosure to distinguish between different categories or sets of elements. For clarity, the terms "first", "second", etc. may represent "first category (or first set)", "second category (or second set)", etc., respectively.

The terms used herein are used only to describe particular embodiments, and are not intended to limit the present disclosure. As used in the present disclosure, a singular expression is intended to include a plural expression as well, and a plural expression is also intended to include a singular expression unless the context clearly indicates otherwise. It will be further understood that the terms "comprises," "comprising," "have," "having," "includes," "including," and the like, when used in this specification, specify the presence of the stated features, integers, steps, operations, elements, and/or components, but do not preclude the presence or addition of one or more other features, integers, steps, operations, elements, components, and/or groups thereof.

When one or more embodiments may be implemented differently, a specific process order may be performed differently from the order described. For example, two processes described in succession may be performed substantially simultaneously, or may be performed in the opposite order to the order described.

Terms "substantially", "about", "approximately" and similar terms are used as terms of approximation rather than degree, and mean satisfying the inherent range of variation in a measured or calculated value (e.g., the range of variation due to limitations of the measurement system). For example, "about" could mean within one or more standard deviations, or within +30%, +20%, +10%, or +5% of a specified value.

Unless otherwise defined, all terms used herein, including technical or scientific terms, have the same meaning as commonly understood by one of ordinary skill in the art to which the disclosure pertains. Terms such as commonly used dictionary-defined terms shall be construed as having meaning consistent with their meaning in the context of the relevant technology and/or the present disclosure, and shall not be idealized or interpreted in an overly formal sense unless explicitly defined herein.

Hereinafter, a charge separating apparatus according to embodiments will be described with reference to FIGS. 1 to 17.

Figure 2:
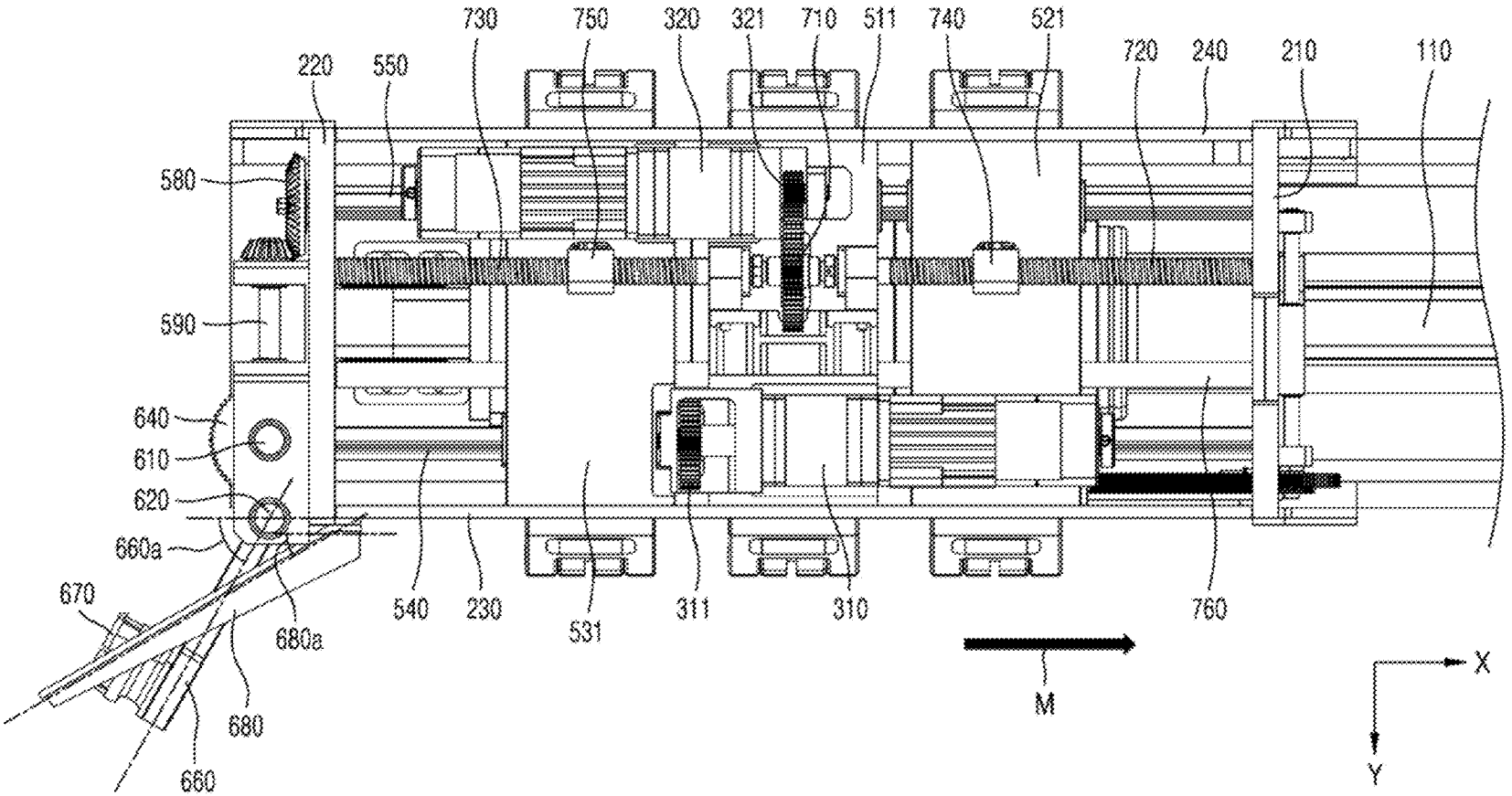
FIG. 2 is a plan view illustrating a charge separating apparatus according to an embodiment.
Figure 3:
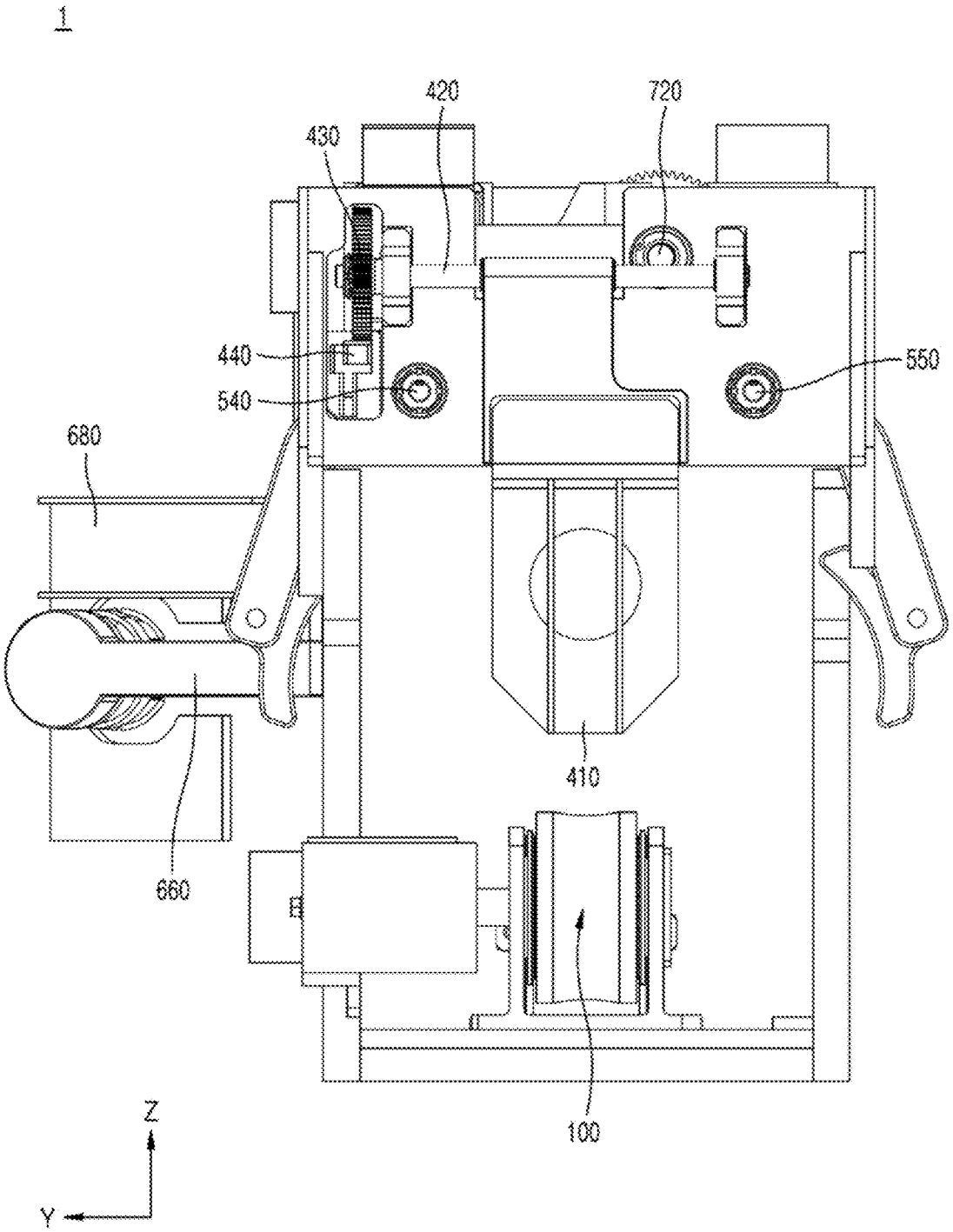
FIG. 3 is a front view illustrating a charge separating apparatus according to an embodiment.
Figure 4:
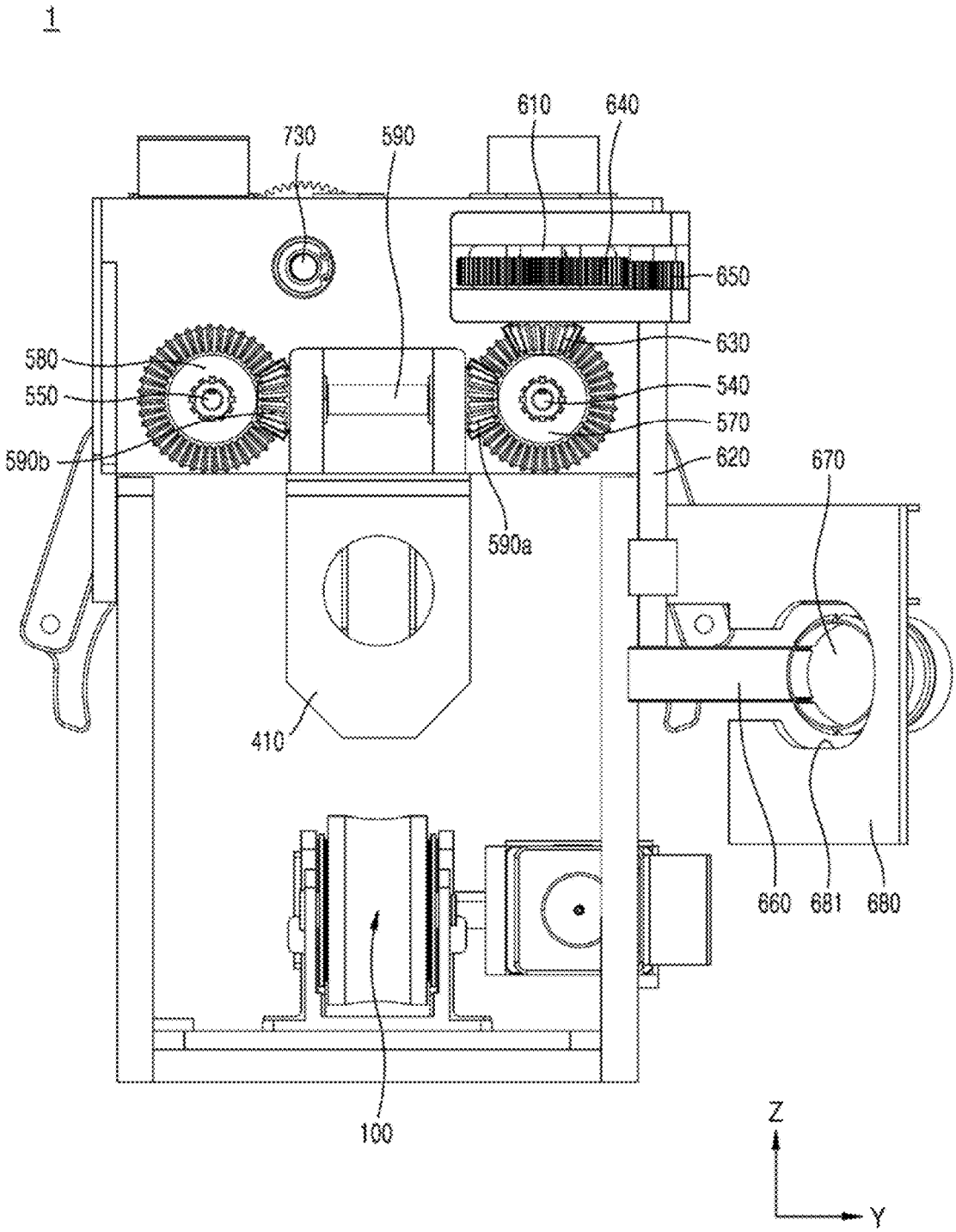
FIG. 4 is a rear view illustrating a charge separating apparatus according to an embodiment.
Figure 5:
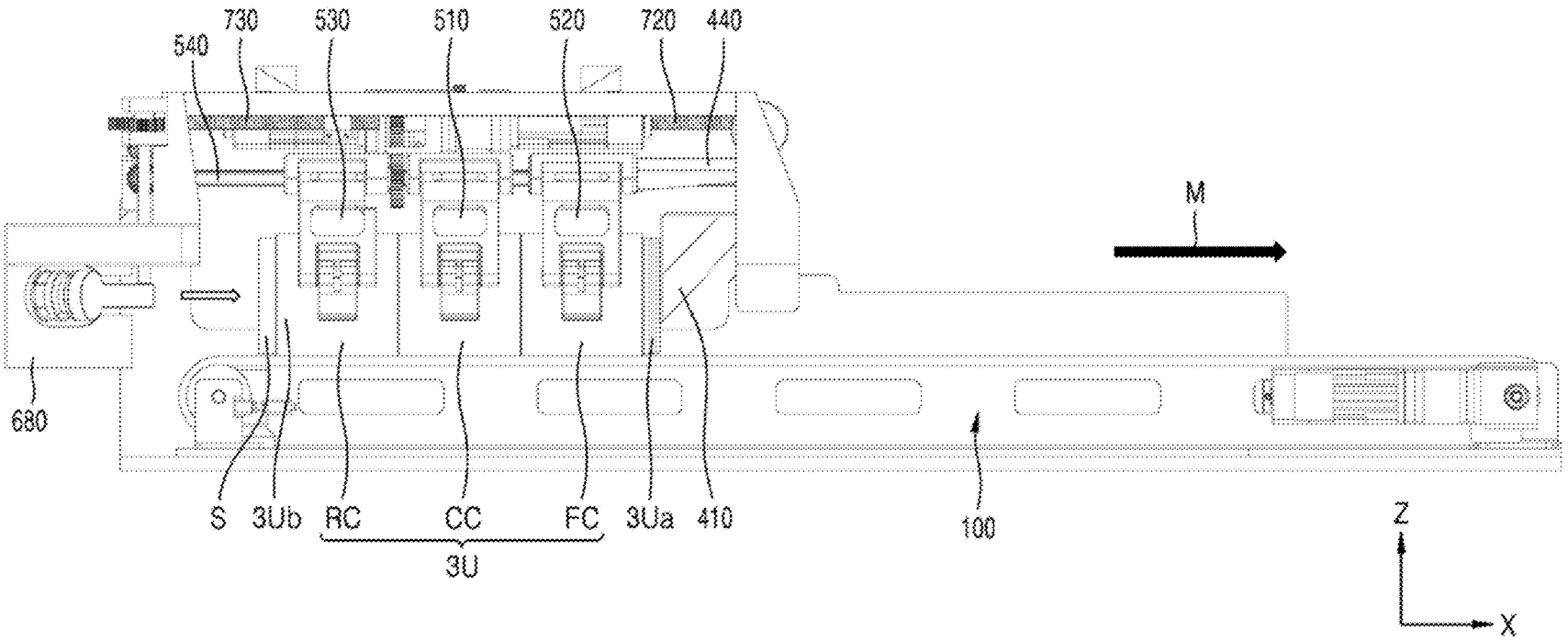
FIG. 5 is a side view illustrating a time instant when a unit of charges is stopped by a door assembly according to an embodiment.

FIG. 1 is a perspective view illustrating a charge separating apparatus 1 according to an embodiment. FIG. 2 is a plan view illustrating the charge separating apparatus 1 according to an embodiment. FIG. 3 is a front view illustrating the charge separating apparatus 1 according to an embodiment. FIG. 4 is a rear view illustrating the charge separating apparatus 1 according to an embodiment. FIG. 5 is a side view illustrating a time instant when one unit of three charges (3U) are stopped by a door assembly 400 according to an embodiment.

The charge separating apparatus 1 separates the central charge (CC), the front charge (FC), and the rear charge (RC) from a unit of three charges (3U) in which a central charge (CC), a front charge (FC), and a rear charge (RC) have been combined, and supplies the separated charges CC, FC, and RC. The charge C may include a desensitizing charge. The desensitization charge is a charge that may prevent explosion due to an external impact by improving a tensile strength compared to a conventional charge. The charge separation device 1 may be included in an ammunition-transport armored vehicle that loads and transfers the charge C in the form of one unit of three charges (3U).

Referring to FIGS. 1 to 4, the charge separating apparatus 1 may include a transporter 100, a support frame 200, a driver 300, a door assembly 400, a gripper 500, a spacer remover 600, a separator 700, a controller, and a position sensor.

The transporter 100 may transfer charges C in a supply direction M. The supply direction M may be a direction toward firepower equipment such as a self-propellent artillery, which is a supply target of the individual charge C, from a place where the unit of three charges 3U is loaded. Referring to FIG. 1, the transporter 100 may include a belt 110, a roller 120, and a transport motor 130.

The belt 110 may extend in the supply direction M. One end of the belt 110 may be connected to a place where the unit of three charges 3U is loaded. The other end (an end in the X-axis direction in FIG. 1) of the belt 110 may be connected to firepower equipment. An upper end of the belt 110 may be concavely curved (see FIG. 7). Accordingly, the contact area with the charge (C) may be increased, such that the charge (C) may be transferred more stably.

Rollers 120 may be respectively connected to both ends of the belt 110 to rotate the belt 110. The transport motor 130 may transmit the driving power to the belt 110 by rotating the rollers 120.

The transporter 100 may be continuously operated without stopping enroute until supply to the firepower equipment is completed. The moving speed of the belt 110 may be kept constant without change while the transporter 100 is operated.

The support frame 200 may serve to support and fix other components of the charge separating apparatus 1. Referring to FIGS. 1 and 2, the support frame 200 may include a front support 210, a rear support 220, a first side support 230, and a second side support 240. The front support 210 and the rear support 220 may include respective surfaces perpendicular to the supply direction M. The front support 210 may support a door assembly 400 to be described later. The rear support 220 may support a spacer remover 600 to be described later. The front support 210 and the rear support 220 may support the gripper 500 and the separator 700 to be described later. The first side support 230 and the second side support 240 support and fix the front support 210 and the rear support 220, and distribute the load applied to the front support 210 and the rear support 220 so that the charge separating apparatus 1 can operate stably.

The driver 300 may supply driving power to the door assembly 400, the gripper 500, the spacer remover 600, and the separator 700. Referring to FIG. 2, the driver 300 may include a first driving motor 310 and a second driving motor 320.

The first driving motor 310 may supply driving power to the gripper 500 and the spacer remover 600. The first driving motor 310 may include a first driving gear 311 fixed to a rotation shaft. The first driving gear 311 may transmit the driving power of the first driving motor 310 to the gripper 500.

The second driving motor 320 may supply driving power to the door assembly 400 and the separator 700. The second driving motor 320 may include a second driving gear 321 fixed to a rotation shaft. The second driving gear 321 may transmit the driving power of the second driving motor 320 to the separator 700.

The first driving motor 310 and the second driving motor 320 may be fixed to a central gripper 510 to be described later. For example, referring to FIGS. 2 and 6, the first driving motor 310 and the second driving motor 320 may be fixed to the top end of a central block 511.

Referring to FIG. 5, the door assembly 400 may stop the front end 3Ua of the unit of three charges 3U at a predetermined position. The predetermined position may be a position of the front end 3Ua of the unit of three charges 3U when the central charge CC, the front charge FC, and the rear charge RC are at positions corresponding to a central gripper 510, a front gripper 520, and a rear gripper 530.

The door assembly 400 may be connected to the front gripper 520. Referring to FIG. 3, the door assembly 400 may include a door 410, a door shaft 420, a pinion gear 430, and a rack gear 440.

The door 410 may be in contact with the front end 3Ua of the unit of three charges 3U and close the supply path of the unit of three of charges 3U, thereby stopping the unit of three charges 3U. One end of the door 410 may be fixed to the door shaft 420. The door 410 may rotate together with the door shaft 420 as a rotation shaft when the door shaft 420 rotates.

The door shaft 420 may extend perpendicular to the supply direction M. The door shaft 420 may be fixed to the pinion gear 430. That is, the door shaft 420 may rotate together when the pinion gear 430 rotates. The pinion gear 430 may be engaged with the rack gear 440. The rack gear 440 may extend in the supply direction. The rack gear 440 may be fixed to a front end of the front gripper 520. Accordingly, when the front gripper 520 is moved in the supply direction M, the rack gear 440 may also be moved in the supply direction M. A process in which the driving power is transmitted to the door assembly 400 to operate the door assembly 400 will be described later.

Figure 6:
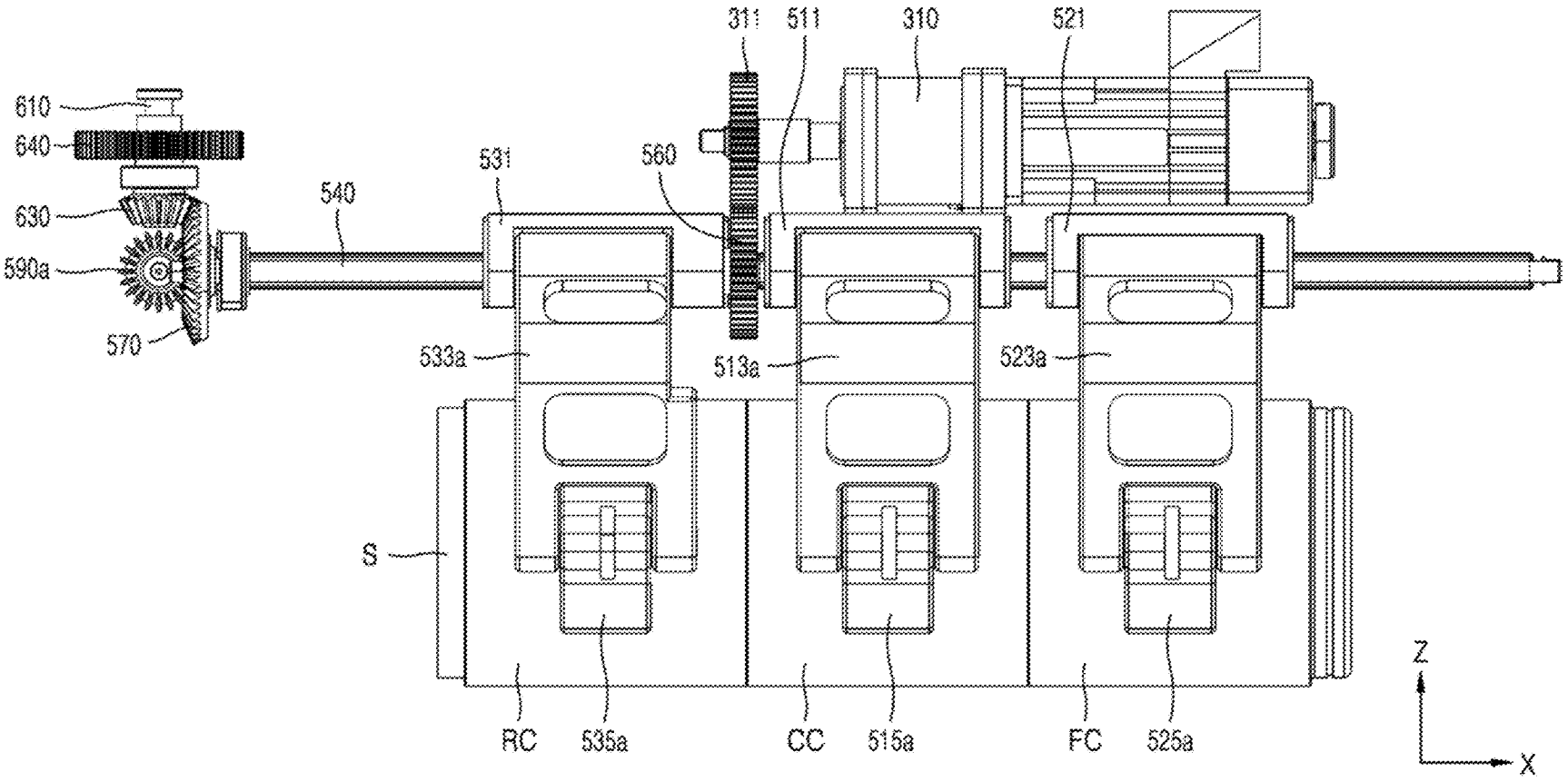
FIG. 6 is a side view illustrating a driving transmission path of a first driving motor according to an embodiment.
Figure 7:
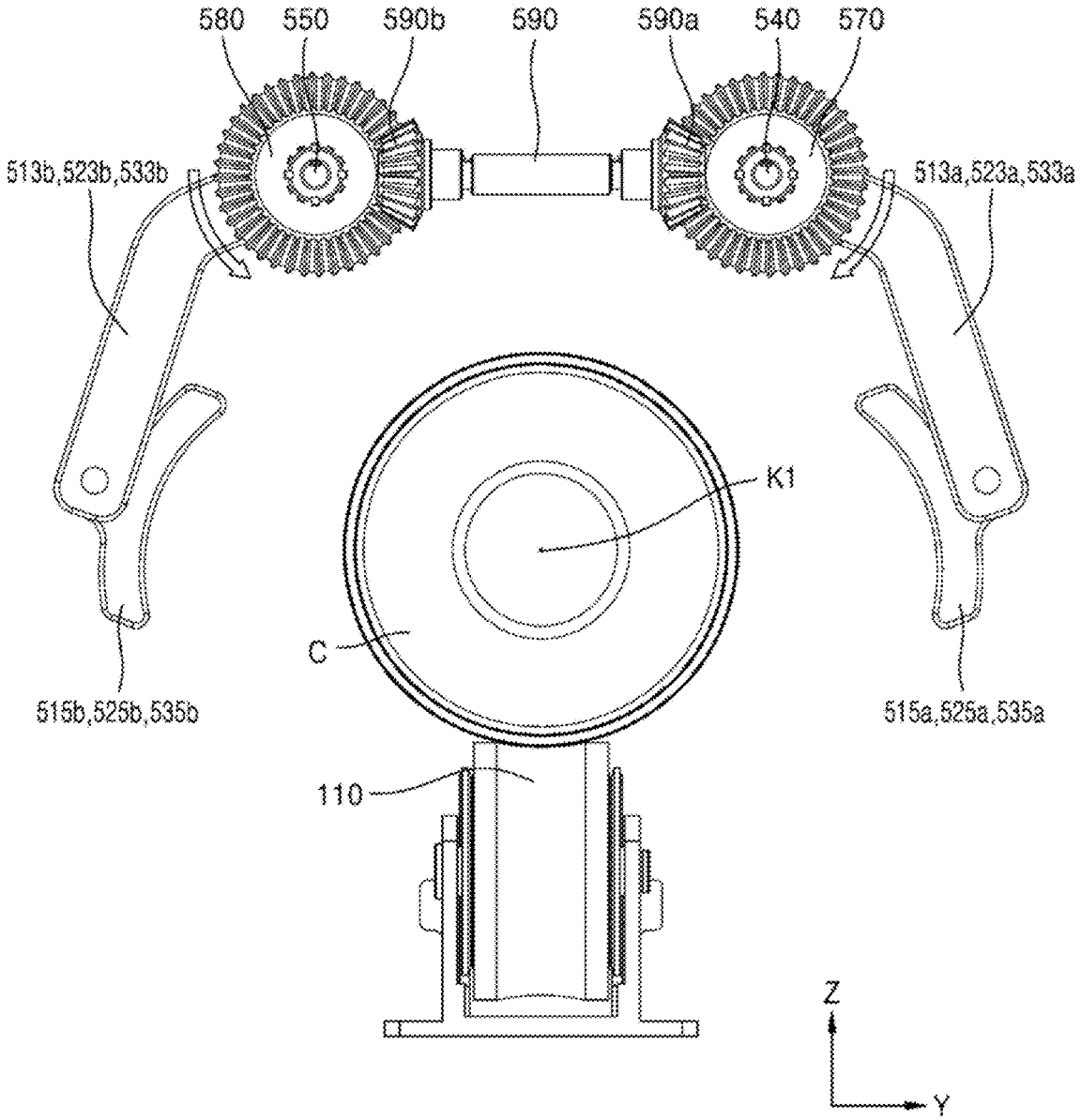
FIG. 7 is a diagram schematically illustrating a state before a gripper grips a charge according to an embodiment.
Figure 8:
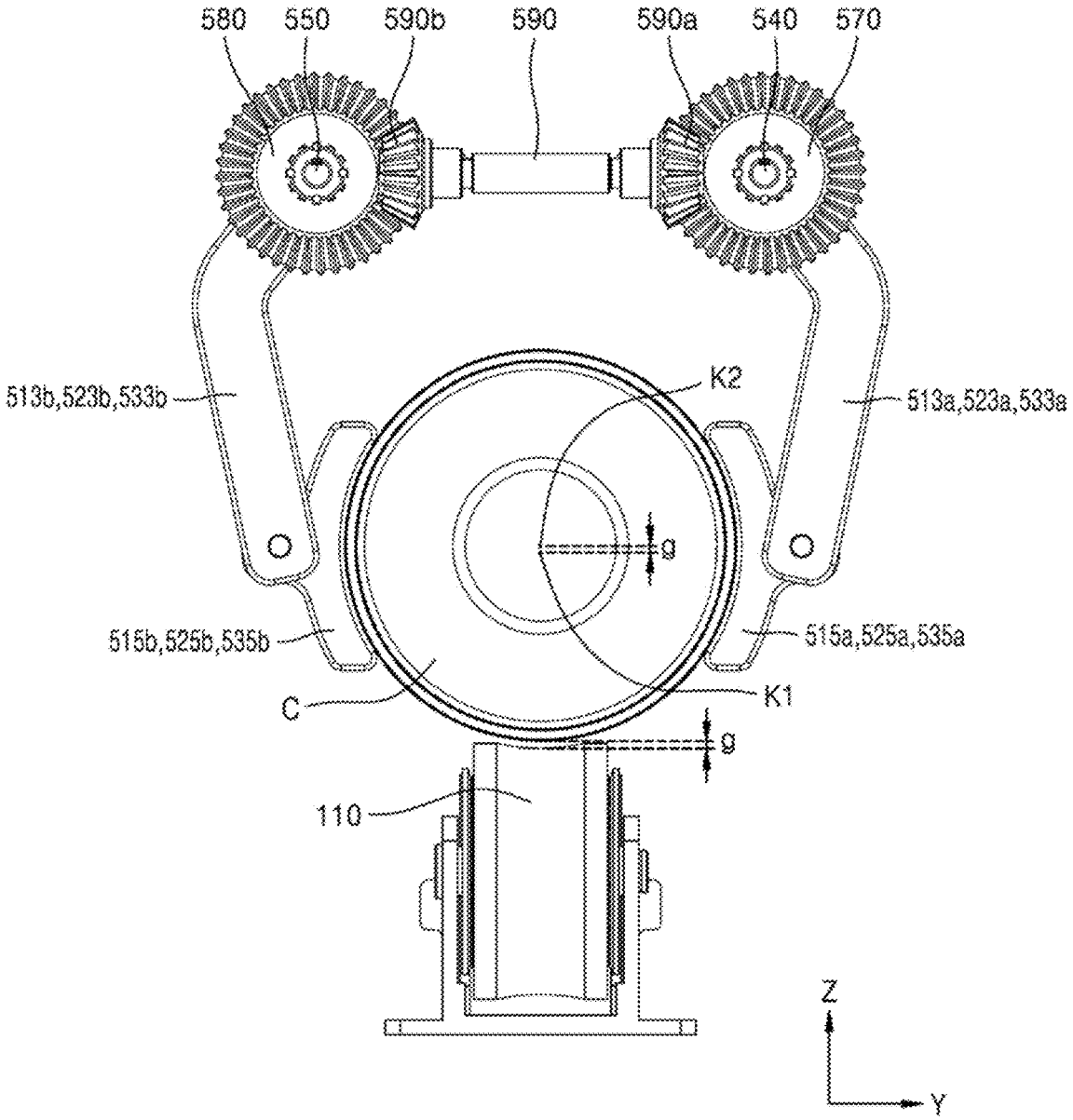
FIG. 8 is a diagram schematically illustrating a state in which a gripper grips a charge according to an embodiment.

FIG. 6 is a side view illustrating a driving transmission path of a first driving motor 310 according to an embodiment. FIG. 7 is a diagram schematically illustrating a state before a gripper 500 grips a charge C according to an embodiment. FIG. 8 is a diagram schematically illustrating a state in which a gripper 500 grips a charge C according to an embodiment.

The gripper 500 may grip the central charge CC, the front charge FC, and the rear charge RC, respectively. Referring to FIGS. 2 and 4 to 10, the gripper 500 may include a center gripper 510, a front gripper 520, a rear gripper 530, a first angle charge rod 540, a second angle charge rod 550, a power transmission gripping gear 560, a power transmission bevel gear 570, an angle changing bevel gear 580, and a bevel gear rod 590.

The central gripper 510 may grip the central charge CC. Referring to FIG. 5, the central charge CC refers to the middle charge C of the unit of three charges 3U. The front gripper 520 may grip the front charge FC. Referring to FIG. 5, the front charge FC refers to the charge C in the supply direction (M) based on the central charge CC. The rear gripper 530 may grip the rear charge RC. Referring to FIG. 5, the rear charge RC refers to the charge C in the opposite direction of the supply direction (M) based on the central charge CC.

The central gripper 510, the front gripper 520, and the rear gripper 530 may include blocks 511, 521, 531, gripping arms 513 (513*a*, 513*b*), 523 (523*a*, 523*b*), and 533 (533*a*, 533*b*), and gripping hands 515 (515*a*, 515*b*), 525 (525*a*, 525*b*), and 535 (535*a*, 535*b*), respectively.

Each of the blocks 511, 521, and 531 may include a C-shape. Both ends of the blocks 511, 521, 531 may be penetrated by the first angle charge rod 540, the second angle charge rod 550, and a guide rod 760, which will be described later.

One end of each of the grip arms 513, 523, and 533 may be inserted into the C-shape unit of each of the blocks 511, 521, and 531, and may be fixed to the first angle charge rod 540 or the second angle charge rod 550. Accordingly, when the blocks 511, 521, and 531 move in the supply direction M or the opposite direction to the supply direction M, the grip arms 513, 523, and 533 may also move in the same direction.

The other ends of the grip arms 513, 523, and 533 may be connected to the grip hands 515, 525, and 535, respectively. Each of the gripping hands 515, 525, and 535 may be in direct contact with the charge C to grip the charge C. The gripping arms 513, 523, and 533 may be connected with the gripping hands 515, 525, and 535 by joints, respectively. Accordingly, each of the grip hands 515, 525, and 535 may rotate with a joint as a rotation axis.

The grip arms 513, 523, and 533 may include first grip arms 513*a*, 523*a*, and 533*a* and second grip arms 513*b*, 523*b*, and 533*b*, respectively. One end of each of the first grip arms 513*a*, 523*a*, and 533*a* may be fixed to a first angle charge rod 540. One end of each of the second grip arms 513*b*, 523*b*, and 533*b* may be fixed to a second angle charge rod 550. The first gripping arms 513*a*, 523*a*, and 533*a* and the second gripping arms 513*b*, 523*b*, and 533*b* may be simultaneously close to or away from the central charge CC, the front charge FC, and the rear charge RC, respectively, by rotation of the first angle charge rod 540 and the second angle charge rod 550. A detailed description thereof will be given later.

The grip hands 515, 525, and 535 may include first grip hands 515*a*, 525*a*, and 535*a* and second grip hands 515*b*, 525*b*, and 535*b*, respectively. The first grip hands 515*a*, 525*a*, and 535*a* may be connected to the first grip arms 513*a*, 523*a*, and 533*a*, respectively. The second grip hands 515*b*, 525*b*, and 535*b* may be connected to the second grip arms 513*b*, 523*b*, and 533*b*, respectively.

The first angle charge rod 540 and the second angle charge rod 550 may change the rotation angles of the gripping arms 513, 523, and 533 to enable gripping of the charge C. The first angle charge rod 540 may receive driving power from the driver 300. Referring to FIG. 2, the first angle change rod 540 may extend in the supply direction M. The second angle charge rod 550 may be parallel to the first angle charge rod 540. The second angle charge rod 550 may be spaced apart from the first angle charge rod 540 by a predetermined distance.

Both ends of each of the first angle charge rod 540 and the second angle charge rod 550 may be supported by the front support 210 and the rear support 220, respectively. Bearings may be arranged at positions where the first angle charge rod 540 and the second angle charge rod 550 are coupled to the support frame 200 including the front support 210 and the rear support 220. Accordingly, the first angle charge rod 540 and the second angle charge rod 550 may be rotatable.

The power transmission grip gear 560 may be engaged with the first driving gear 311. That is, the power transmission grip gear 560 may receive driving power from the first driving motor 310. For example, referring to FIG. 6, the power transmission grip gear 560 may be fixed to the first angle change rod 540. Accordingly, the first angle charge rod 540 may rotate together with the power transmission grip gear 560. That is, the power transmission grip gear 560 may transmit the received driving power to the first angle change rod 540.

The power transmission bevel gear 570 may transmit power to the second angle charge rod 550. In addition, the power transmission bevel gear 570 may transmit power to the spacer remover 600. Referring to FIG. 6, the power transmission bevel gear 570 may be fixed to one end of the first angle change rod 540. Accordingly, the power transmission bevel gear 570 may rotate together when the first angle charge rod 540 rotates. For example, referring to FIG. 2, the angle changing bevel gear 580 may be fixed to one end of the second angle charge rod 550.

The bevel gear rod 590 may transmit the driving power of the first angle change rod 540 to the second angle change rod 550, and simultaneously, may allow the rotation directions of the first angle change rod 540 and the second angle change rod 550 to be opposite to each other.

Referring to FIG. 6, one end 590*a* of the bevel gear rod may be engaged with the power transmission bevel gear 570. The other end 590*b* of the bevel gear rod may be engaged with the angle changing bevel gear 580. As described above, the power transmission bevel gear 570 may be fixed to one end of the first angle charge rod 540, and the angle changing bevel gear 580 may be fixed to one end of the second angle charge rod 550, so that the first angle charge rod 540 and the second angle charge rod 550 may be engaged and connected to both ends of the bevel gear rod 590, respectively.

The first angle charge rod 540 and the second angle charge rod 550 may rotate in opposite directions by the first driving motor 310. Referring to FIGS. 6 and 7, the driving power in the first direction (upward rotation in FIG. 6) generated from the first driving motor 310 may be transmitted to the first driving gear 311 and the power transmission grip gear 560 in order to rotate the first angle change rod 540 clockwise on FIG. 7. At the same time, the driving power may be sequentially transmitted to the power transmission bevel gear 570, the bevel gear rod 590, and the angle change bevel gear 580 fixed to one end of the first angle change rod 540, so that the second angle change rod 550 may be rotated counterclockwise on FIG. 7.

Referring to FIGS. 7 and 8, the first grip arms 513*a*, 523*a*, and 533*a* fixed to the first angle charge rod 540 may rotate in a clockwise direction together as the first angle charge rod 540 rotates in a clockwise direction. Accordingly, the first grip hands 515*a*, 525*a*, and 535*a* connected to the first grip arms 513*a*, 523*a*, and 533*a*, respectively, may be in contact with the charge C. At the same time, the second grip arms 513*b*, 523*b*, and 333*b* fixed to the second angle change rod 550 may rotate counterclockwise together as the second angle change rod 550 rotates counterclockwise. Accordingly, the second grip hands 515*b*, 525*b*, and 535*b* connected to the second grip arms 513*b*, 523*b*, and 533*b*, respectively, may be in contact with the charge C.

In this way, as the first angle charge rod 540 and the second angle charge rod 550 rotate in opposite directions, the gripping hands 515, 525, and 535 may grip the charges C, respectively.

The charge C may be in contact with the belt 110 until the gripper 500 grips the charge C. In this case, the belt 110 may be continuously rotated and the charge C may be stopped by the door 410. In this case, the gripper 500 may lift the charge C while gripping and holding the charge C to separate the charge C from the belt 110. Referring to FIGS. 7 and 8, the center K2 of the charge C after the gripper 500 grips the charge C may have a height difference g from the center K1 of the charge C immediately before the gripper 500 grips the charge C. Accordingly, the charge C may be maintained in a gripped state regardless of the rotation of the belt 110. In other words, the belt 110 may operate at a constant speed regardless of whether or not the charge C is gripped. Accordingly, it is possible to reduce the time required to directly stop and re-operate the belt 110, and to quickly distribute the charge C.

In an embodiment, an elastic member may be arranged at a joint between the grip arms 513, 523, and 533 and the grip hands 515, 525, and 535, respectively. The elastic members may move the grip hands 515, 525, and 535, respectively, to maximize the contact area between each of the grip hands 515, 525 and 535 and the charge C.

In an embodiment, a rotation driving member may be arranged at a joint between the grip arms 513, 523, and 533 and the grip hands 515, 525, and 535, respectively. The rotation driving members may rotate the grip hands 515, 525, and 535, respectively, with a joint as a rotation axis. Accordingly, the adhesion between each of the gripping hands 515, 525, and 535 and the charge C may be improved, and the value of the height difference g at which the charge C is lifted may be adjusted.

Figure 9:
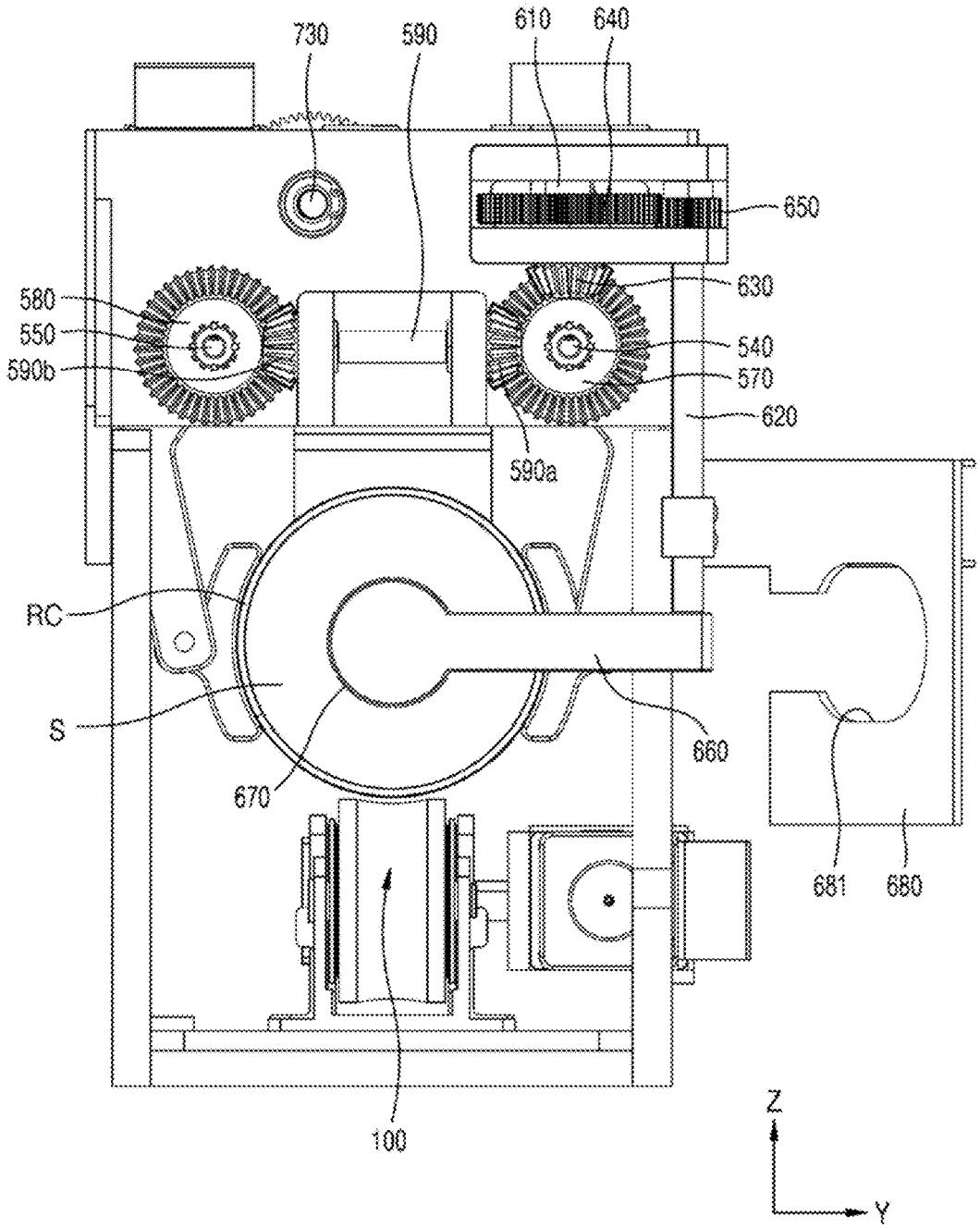
FIG. 9 is a rear view illustrating a process of operating a gripper and a spacer remover by a first driving motor according to an embodiment.
Figure 10:
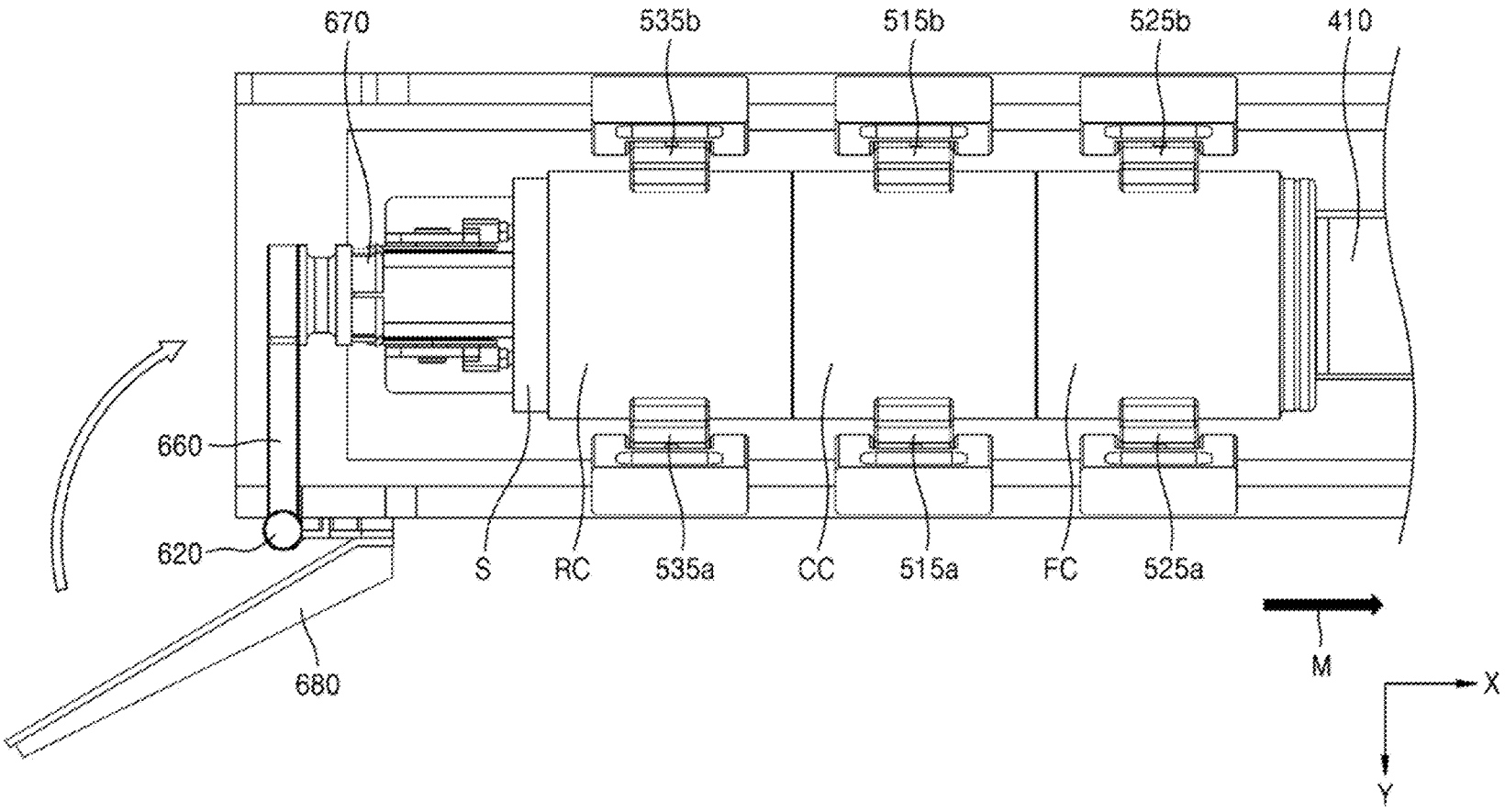
FIG. 10 is a diagram showing a coupling bar and a spacer coupler according to an embodiment.
Figure 11:
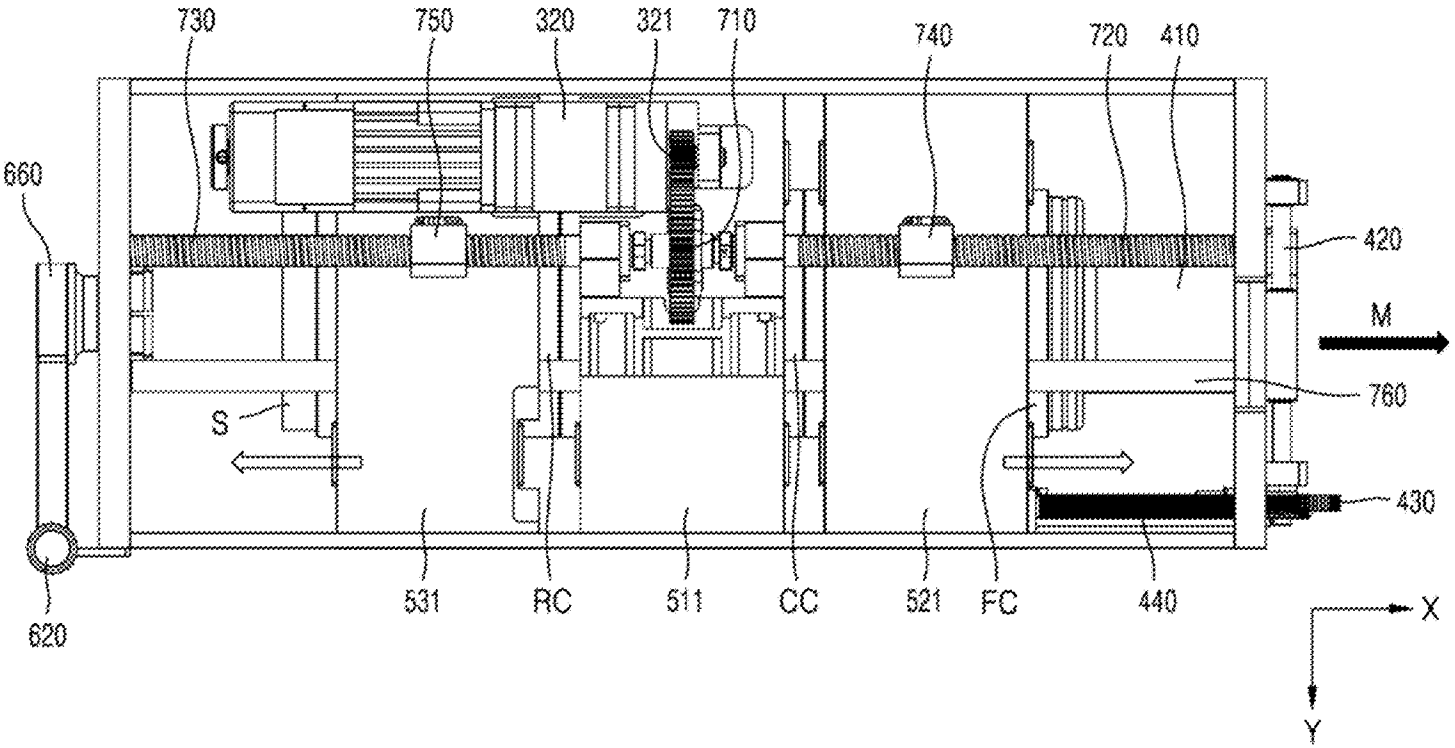
FIG. 11 is a plan view schematically illustrating a process of operating a gripper and a spacer remover by a first driving motor according to an embodiment.

FIG. 9 is a rear view illustrating a process of operating a gripper 500 and a spacer remover 600 by a first driving motor 310 according to an embodiment. FIG. 10 is a diagram showing a coupling bar 660 and a spacer coupler 670 according to an embodiment. FIG. 11 is a plan view schematically illustrating a process of operating a gripper 500 and a spacer remover 600 by a first driving motor 310 according to an embodiment.

The spacer remover 600 may remove the spacer S at the rear end 3Ub of the unit of three charges 3U from the rear charge RC. The spacer S may be arranged at the rear side of the rear charge RC so that an interval between the unit of three charges 3U and another unit of three charges 3U is maintained. Referring to FIGS. 9 to 11, the spacer remover 600 may include a first removal shaft 610, a second removal shaft 620, a removal bevel gear 630, a first spur gear 640, a second spur gear 650, a coupling rod 660, a spacer coupler 670, and a separation wall 680.

The first removal shaft 610 may transmit power to the second removal shaft 620. The first removal shaft 610 may extend in the height direction (Z-axis). The second removal shaft 620 may rotate the coupling rod 660. The second removal shaft 620 may be parallel to the first removal shaft 610.

The removal bevel gear 630 may receive the driving power of the first driving motor 310 from the power transmission bevel gear 570 described above. The removal bevel gear 630 may be fixed to one end of the first removal shaft 610. The removal bevel gear 630 may be engaged with the power transmission bevel gear 570.

The first spur gear 640 and the second spur gear 650 may transmit, to the second removal shaft 620, the power transmitted to the first removal shaft 610. The first spur gear 640 may be fixed to the first removal shaft 610. The second spur gear 650 may be fixed to the second removal shaft 620. The second spur gear 650 may be engaged with the first spur gear 640.

The coupling rod 660 may access the spacer S by moving the spacer coupler 670, and may serve to move the spacer S coupled to the spacer coupler 670. One end of the coupling rod 660 may be connected to the second removal shaft 620. The coupling rod 660 may rotate with one end as a central axis. That is, the coupling rod 660 may rotate with the second removal shaft 620 as a central axis.

The driving power generated in the first driving motor 310 in the first direction (upward rotation in FIG. 6) may be transmitted to the first driving gear 311, the power transmission gripping gear 560, the first angle charge rod 540, the power transmission bevel gear 570, the removal bevel gear 630, the first removal shaft 610, the first spur gear 640, the second spur gear 650, and the second removal shaft 620 in turn, in order to rotate the coupling rod 660 clockwise on FIG. 11. In this case, the coupling rod 660 may rotate up to a position perpendicular to the supply direction M.

The spacer coupler 670 may be coupled to the spacer S. The spacer coupler 670 may be located at the other end of the coupling rod 660. As shown in FIG. 10, the shape of one end 670*a* of the spacer coupler may include a hook shape. The spacer S may be coupled to the spacer coupler 670 by a shape of one end 670*a* of the spacer coupler.

The separation wall 680 may serve to separate, from the spacer coupler 670, the spacer S coupled to the spacer coupler 670. The separation wall 680 may be arranged perpendicular to the rotational trajectory of the spacer coupler 670. Referring to FIG. 2, an angle 680*a* between the separation wall 680 and the supply direction M may be less than an angle 660*a* between the supply rod 660 and the supply direction M when the coupling rod 660 rotates to the maximum clockwise on FIG. 2. In addition, referring to FIG. 4, the separation wall 680 may have an opening 681 through which the coupling rod 660 may pass. Therefore, when the coupling rod 660 rotates to the maximum clockwise direction on FIG. 2, the coupling rod 660 may pass through the opening 681 of the separation wall 680. The functions and effects thereof are described later.

Operations of the gripper 500 and the spacer remover 600 by the first driving motor 310 are summarized as follows. When the first driving motor 310 is driven in the first direction (upward rotation in FIG. 6), the gripper 500 may grip the central charge CC, the front charge FC, and the rear charge RC, respectively, and at the same time, the spacer coupler 670 of the spacer remover 600 may move toward the spacer S (see FIG. 11).

Figure 12:
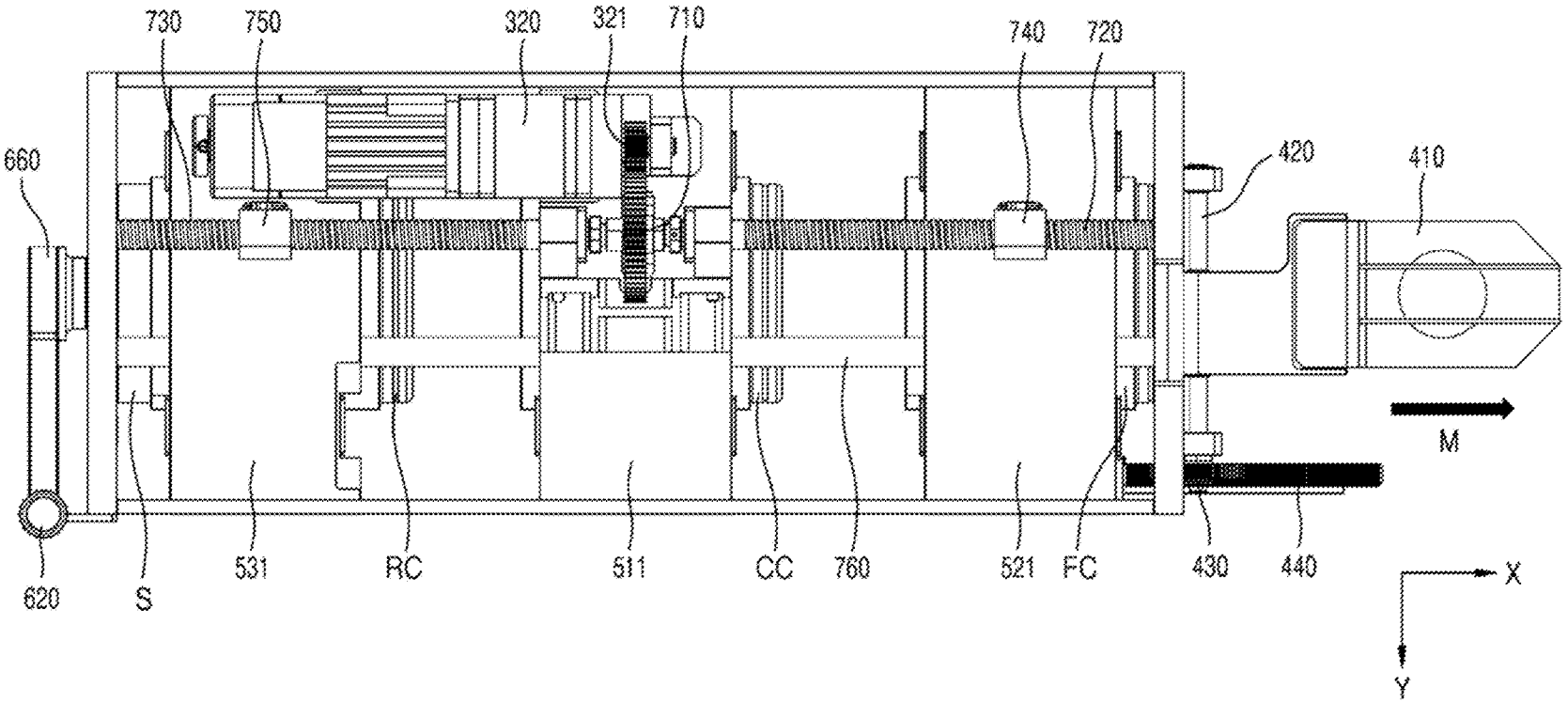
FIG. 12 is a plan view illustrating a driving transmission path of a second driving motor according to an embodiment.
Figure 13:
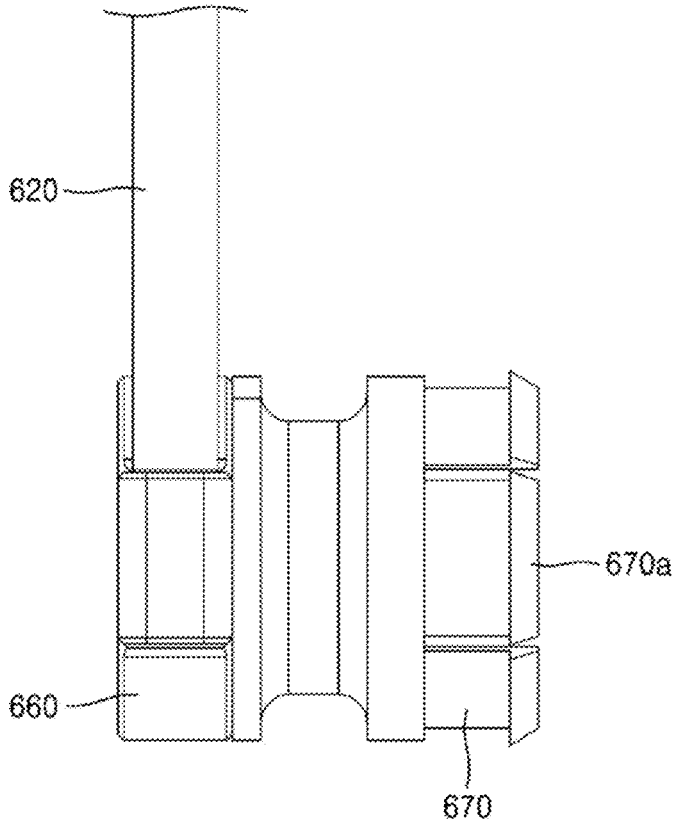
FIG. 13 is a plan view schematically illustrating a process of operating a door assembly and a separator by a second driving motor according to an embodiment.
Figure 14:
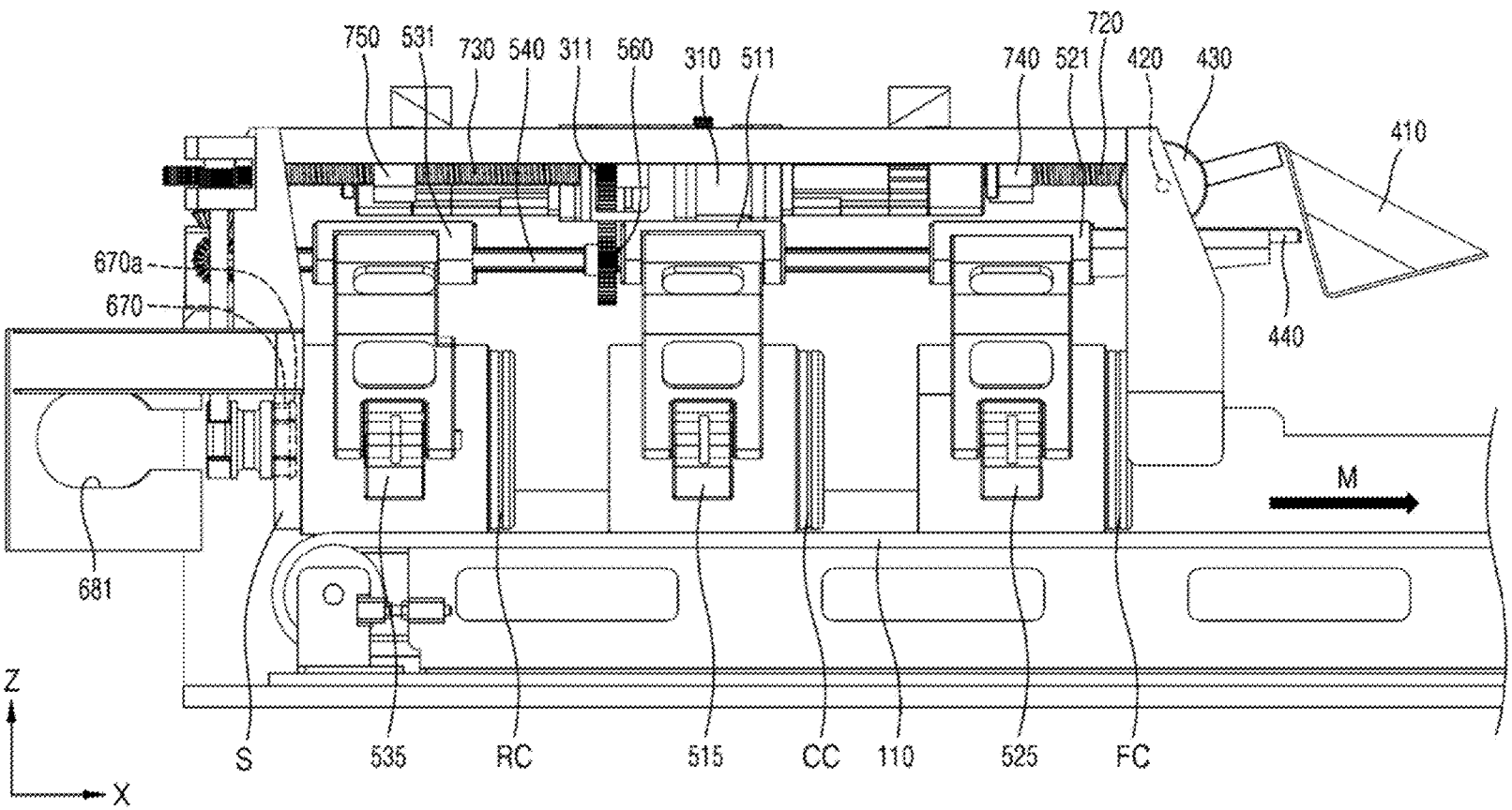
FIG. 14 is a side view illustrating a state in which a front charge and a rear charge are separated by a separator according to an embodiment.

FIG. 12 is a plan view illustrating a driving transmission path of a second driving motor 320 according to an embodiment. FIG. 13 is a rear view illustrating a process of operating a door assembly 400 and a separator 700 by a second driving motor 320 according to an embodiment. FIG. 14 is a side view illustrating a state in which a front charge FC and a rear charge RC are separated by a separator 700 according to an embodiment.

The separator 700 may serve to separate the front charge FC and the rear charge RC of the unit of three charges 3U from the central charge CC. That is, the separator 700 may move the front charge FC in the supply direction M. The separator 700 may move the rear charge RC in a direction opposite to the supply direction M. Referring to FIGS. 12 to 14, the separator 700 may include a power transmission separation gear 710, a front screw rod 720, a rear screw rod 730, a front nut 740, a rear nut 750, and a guide rod 760.

The power transmission separation gear 710 may receive driving power from the driver 300. For example, the power transmission separation gear 710 may receive driving power from the second driving motor 320. That is, the power transmission separation gear 710 may be engaged with the second driving gear 321. According to an embodiment, the rotation shaft of the power transmission separation gear 710 may be supported on the top end of the central block 511.

The front screw rod 720 and the rear screw rod 730 may receive driving power from the power transmission separation gear 710 to move the front nut 740 and the rear nut 750, respectively. One end of the front screw rod 720 may be fixed to the power transmission separation gear 710. The front screw rod 720 may extend in the supply direction M. One end of the rear screw rod 730 may be fixed to the power transmission separation gear 710. The rear screw rod 730 may have the same central axis as the front screw rod 720. The screw direction of the rear screw rod 730 may be opposite to the screw direction of the front screw rod 720. Accordingly, as the front screw rod 720 and the rear screw rod 730 all fixed to the power transmission separation gear 710 rotate in the same direction, the moving directions of the front nut 740 and the rear nut 750 may be reversed.

The front nut 740 may be connected to the front screw rod 720. One end of the front nut 740 may be fixed to the front gripper 520. For example, one end of the front nut 740 may be fixed to the top end of the front block 521. Accordingly, when the front screw rod 720 rotates, the front nut 740 may move in the supply direction M, and the front gripper 520 fixed to the front nut 740 may also move in the supply direction M. In this case, since the front gripper 520 is configured to grip the front charge FC, the front charge FC may also move in the supply direction M by the movement of the front nut 740 in the supply direction M, and thus may be separated from the center charge CC.

The rear nut 750 may be connected to the rear screw rod 730. One end of the rear nut 750 may be fixed to the rear gripping unit 530. For example, one end of the rear nut 750 may be fixed to the top end of the rear block 531. Accordingly, when the rear screw rod 730 rotates, the rear nut 750 may move in the opposite direction of the supply direction M, and the rear gripper 530 fixed to the rear nut 750 may also move in the opposite direction of the supply direction M. In this case, since the rear gripper 530 grips the rear charge RC, the rear charge RC may also be separated from the central charge CC while moving in the opposite direction of the supply direction M by the movement of the rear nut 750 in the opposite direction of the supply direction M.

The guide rod 760 may guide the front nut 740 and the rear nut 750 to move in the supply direction M and a direction opposite to the supply direction M, respectively, without rotating together the front screw rod 720 and the rear screw rod 730. The guide rod 760 may extend parallel to the supply direction M. The guide rod 760 may pass through the front gripper 520 and the rear gripper 530. Accordingly, the front gripper 520 and the rear gripper 530 may move along the guide rod 760.

In an embodiment, the central block 511 may be fixed to the guide rod 760. Accordingly, when the front gripper 520 and the rear gripper 530 move, the center gripper 510 may be fixed.

A process in which the driving power is transmitted to the door assembly 400 to operate the door assembly 400 is as follows. The door assembly 400 may receive driving power as the front gripper 520 moves in the supply direction M. Referring to FIGS. 12 to 14, as described above, the rack gear 440 may be fixed to the front end of the front gripper 520. The driving power generated by the second driving motor 320 may move the front gripper 520 in the supply direction M. Accordingly, the rack gear 440 fixed to the front gripper 520 may also move in the supply direction M. As the rack gear 440 moves in the supply direction M, the pinion gear 430 engaged with the rack gear 440 may rotate counterclockwise on FIG. 14, and the door shaft 420 fixed to the pinion gear 430 may also rotate counterclockwise on FIG. 14. Accordingly, as shown in FIGS. 13 and 14, the door 410 fixed to the door shaft 420 rotates, so that the supply path of the charge C may be opened.

When the rear gripper 530 moves the rear charge RC in a direction opposite to the supply direction M, the spacer S arranged at the rear end of the rear charge RC may be in contact with and coupled to the spacer coupler 670.

Operations of the separator 700 and the door assembly 400 by the second driving motor 320 are summarized as follows. When the second driving motor 320 is driven, the separator 700 may move the front gripper 520 in the supply direction M and move the rear gripper 530 in a direction opposite to the supply direction M. Accordingly, the front charge FC gripped by the front gripper 520 may be moved in the supply direction M, and the rear charge RC gripped by the rear gripper 530 may be moved in the opposite direction to the supply direction M, to be separated from the central charge CC. At the same time, the movement of the front gripper 520 in the supply direction M may rotate the door 410 to open the supply path of the charge C. Additionally, the spacer S may be coupled to the spacer coupler 670 by the movement of the rear charge RC.

Figure 15:
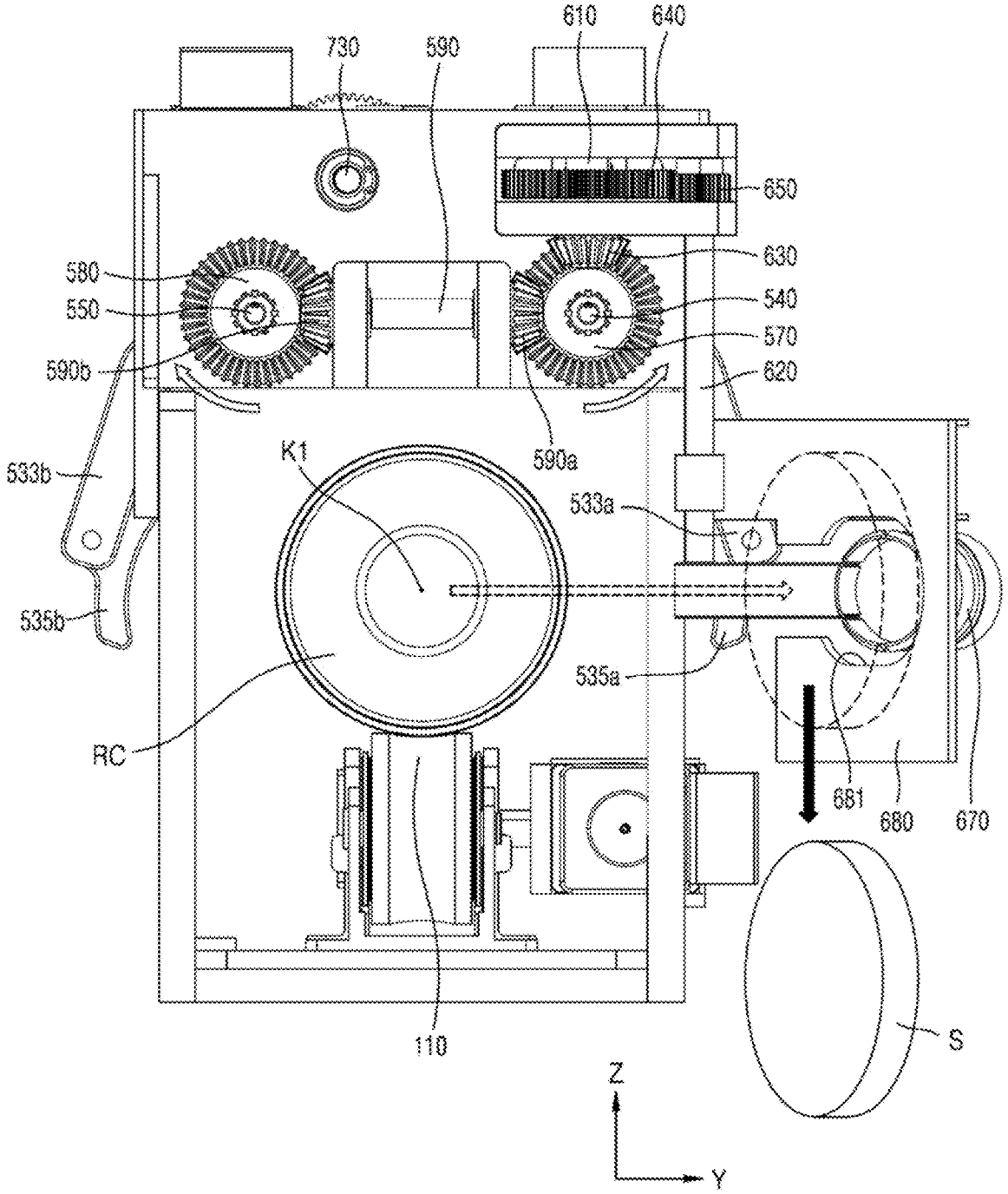
FIG. 15 is a rear view illustrating a process of removing a spacer from a rear charge by a spacer removal unit according to an embodiment.
Figure 16:
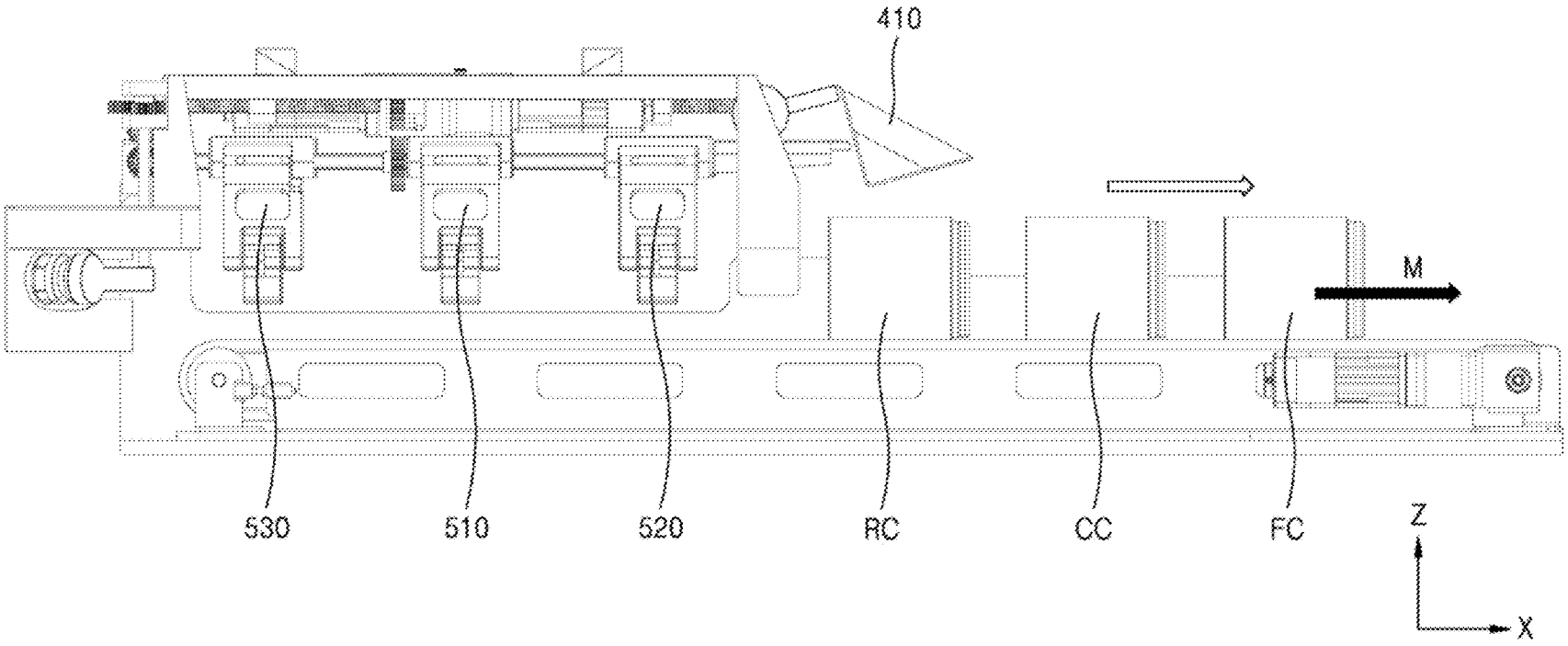
FIG. 16 is a side view illustrating a process in which the front charge, the central charge, and the rear charge, which have been completely separated, are transferred in a supply direction an embodiment.
Figure 17:
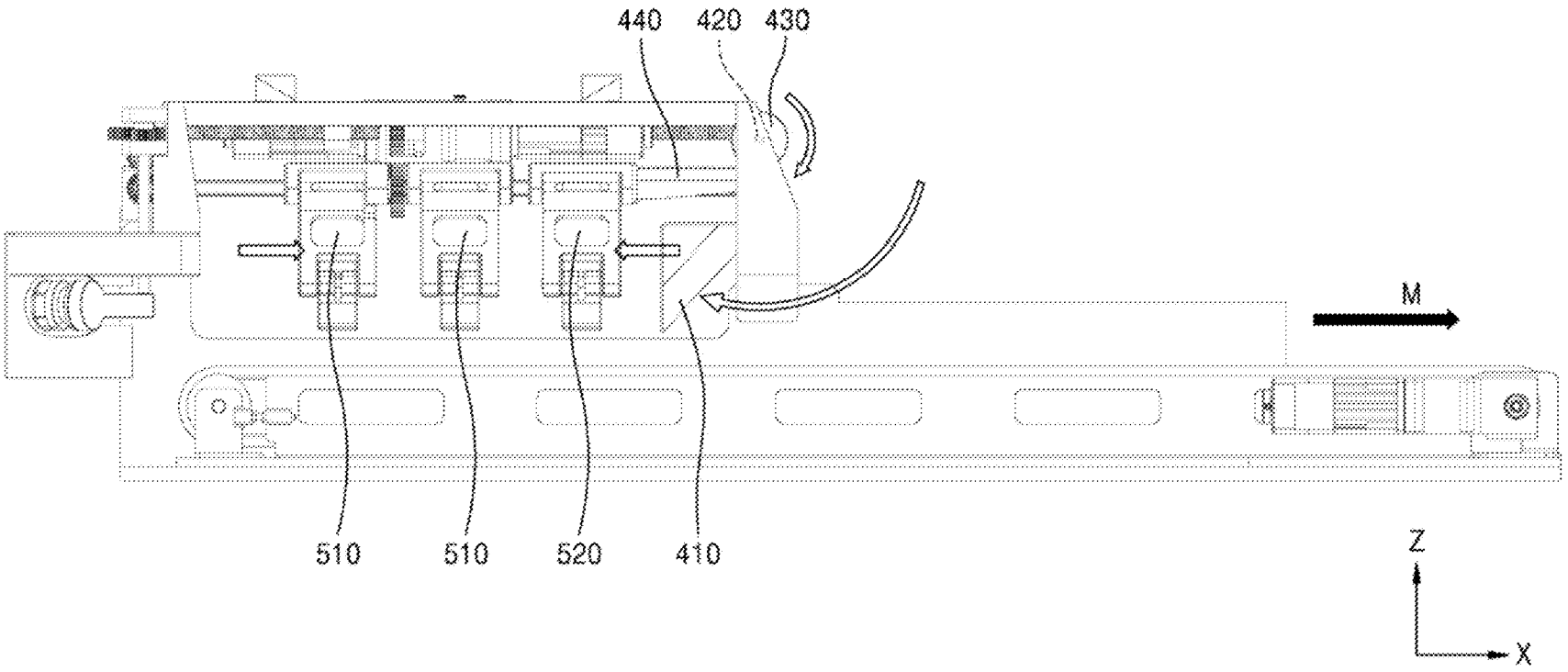
FIG. 17 is a side view illustrating a process of returning the gripper and the door assembly to the original state after the transfer of the charge an embodiment.

FIG. 15 is a rear view illustrating a process of removing a spacer S from a rear charge RC by a spacer remover 600 according to an embodiment. FIG. 16 is a side view illustrating a process in which the front charge FC, the central charge CC, and the rear charge RC which have been completely separated are transferred in a supply direction M an embodiment. FIG. 17 is a side view illustrating a process of returning the gripper 500 and the door assembly 400 to the original state after the transfer of the charge C an embodiment.

After the separation of the unit of three charges 3U is completed by the separator 700, the first driving motor 310 may be driven in a direction opposite to the first direction (upward rotation in FIG. 6). When the first driving motor 310 is driven in a direction opposite to the first direction (upward rotation in FIG. 6), the gripper 500 may release the gripping of the central charge CC, the front charge FC, and the rear charge RC, and at the same time, the spacer remover 600 may remove the spacer S from the rear charge RC. The process in which the gripper 500 releases the gripping of the charge C is in the reverse order of the process in which the gripper 500 grips the charge C, and thus, a detailed description thereof will be omitted.

Referring to FIG. 14, a state in which the separation of the unit of three charges 3U is completed may be a state in which the spacer S is coupled to the spacer coupler 670. In this case, as the first driving motor 310 is driven in a direction opposite to the first direction, the coupling rod 660 may rotate counterclockwise on FIG. 11 and return to the original position (see FIG. 2). The coupling rod 660 may pass through the opening 681 of the separation wall 680 while returning to the original position. The shape and size of the opening 681 may be configured to pass through the coupling rod 660 but may not be configured to pass through the spacer S. Accordingly, as shown in FIG. 15, the spacer S may fall down by the separation wall 680.

In addition, the central charge CC, the front charge FC, and the rear charge RC in a state in which the separation is completed may be in contact with the belt 110 again when the gripping by the gripper 500 is released (see FIG. 7). The central charge CC, the front charge FC, and the rear charge RC may be transferred in the supply direction M by the belt 110. Referring to FIGS. 16 and 17, the second driving motor 320 may be driven in the opposite direction to the case of separating the unit of three charges 3U at a predetermined time point when the rear charge RC is not encumbered at the time of the return of the door 410 to its original position. Accordingly, the front gripper 520 may move in a direction opposite to the supply direction M and the rear gripper 530 may move in the supply direction M. That is, the front gripper 520 and the rear gripper 530 may return to their original positions, respectively. Simultaneously, the door 410 may rotate counterclockwise on FIGS. 16 and 17 to return to its original position.

A controller may control all operations of the charge separating apparatus 1. In an embodiment, the controller may be electrically connected to the first driving motor 310 and the second driving motor 320. The controller may transmit a control signal such as a driving direction and speed to the first driving motor 310 and the second driving motor 320. The controller may be physically implemented by analog and/or digital circuits including one or more of a logic gate, an integrated circuit, a microprocessor, a microcontroller, a memory circuit, a passive electronic component, an active electronic component, and the like, and may implement or execute software and/or firmware to perform the functions or operations of the first driving motor 310 and the second driving motor 320.

A position sensor may determine the position of the front end 3Ua of the unit of three charges or whether the front end 3Ua of the unit of three charges reaches a specific position. The position sensor may transmit, to the controller, position information on the front end 3Ua of the unit of three charges. The controller may transmit an operation signal of the first driving motor 310 in consideration of the position information.

Since the charge separating apparatus 1 automatically separates the unit of three charges 3U and automatically removes the spacer at the same time, it is possible to quickly and efficiently supply the charge. Accordingly, continuous use of firepower equipment such as self-propelled artillery is possible. In addition, it is possible to reduce operating personnel through automation, thereby solving the problem of reducing troop resources.

Specific technical content described in the disclosure is merely exemplary, and does not limit the technical scope of the disclosure. In order to concisely and clearly describe the description of the disclosure, descriptions of conventional general techniques and configurations may be omitted. In addition, the connection or connection members of lines between the components shown in the drawings illustratively represent functional connection and/or physical or circuit connections, and may be replaceable or represented as various additional functional connections, physical connections, or circuit connections in an actual device. In addition, if there is no specific mention, such as "essential" and "important," it may not be an essential component for the application of this disclosure.

The terms "the" and the like used in the description and the claims of the disclosure may refer to "the singular" and "the plural" unless specifically limited thereto. In addition, when a range is described in the embodiment, the scope of the disclosure includes an embodiment to which individual values belonging to the range are applied (if there is no contrary description), as described in the description of the disclosure, each individual value constituting the range above. In addition, if there is no obvious order or contrary description of the steps or operations constituting the method according to the embodiment, the above steps or operations may be performed in an appropriate order. The embodiments are not necessarily limited to the written order of the steps or operations. The use of all examples or terms (e.g., etc.) in the embodiment is simply for describing the embodiment in detail, and thus, unless the scope of the embodiment is limited by the claims, the scope of the embodiment is not limited by the examples or terms. In addition, one of ordinary skill in the art may see that various modifications, combinations, and changes may be constructed according to design conditions and factors within the scope of the accompanying claims or their equivalents.

The charge separating apparatus according to an embodiment of the present disclosure may automatically separates a unit of three charges, thereby enabling rapid and efficient supply of charges. Accordingly, continuous use of firepower equipment such as self-propelled artillery may be possible. In addition, it is possible to reduce operating personnel through automation, thereby solving the problem of reducing troop resources.

According to an embodiment of the present disclosure, the charge separating apparatus may be efficient because it can simultaneously provide driving power to the gripper, the spacer remover, the separator, and the door assembly with two driving motors.

The effects of the disclosure are not limited to the effects described above, and other effects not mentioned may be clearly understood by those skilled in the art from the present disclosure and the accompanying drawings.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure. Accordingly, the scope of the disclosure should be interpreted as encompassing all modifications or variations derived based on the technical spirit of various embodiments of the disclosure in addition to the embodiments disclosed herein.

What is claimed is:

1. A charge separating apparatus comprising:

a transporter configured to move charges in a supply direction;

a door assembly configured to stop a front end of a unit of three charges at a predetermined position, the unit of three charges comprising a combination of a central charge, a front charge, and a rear charge;

a gripper configured to grip each of the central charge, the front charge, and the rear charge;

a separator configured to move the front charge in the supply direction and move the rear charge in a direction that is opposite to the supply direction; and a driver configured to supply driving power to the door assembly, the gripper, and the separator.

2. The charge separating apparatus of claim 1, wherein the driver comprises:

a first driving motor configured to supply driving power to the gripper; and a second driving motor configured to supply driving power to the door assembly and the separator.

3. The charge separating apparatus of claim 1, wherein the gripper comprises:

a center gripper configured to grip the central charge;

a front gripper configured to grip the front charge; and a rear gripper configured to grip the rear charge, and wherein the door assembly is connected to the front gripper and configured to receive driving power in a state in which the front gripper moves in the supply direction.

4. The charge separating apparatus of claim 3, wherein the door assembly comprises:

a rack gear fixed to a front end of the front gripper and extending in the supply direction;

a pinion gear engaged with the rack gear;

a door shaft fixed to the pinion gear and extending in a direction perpendicular to the supply direction; and a door fixed to the door shaft at an end of the door.

5. The charge separating apparatus of claim 3, wherein the separator comprises:

a power transmission separation gear configured to receive driving power from the driver;

a front screw rod extending in the supply direction and fixed to the power transmission separation gear at an end of the front screw rod;

a front nut connected to the front screw rod and fixed to the front gripper at an end of the front nut; and a guide rod penetrating the front gripper and extending parallel to the supply direction.

6. The charge separating apparatus of claim 5, wherein the separator further comprises:

a rear screw rod fixed to the power transmission separation gear at an end of the rear screw rod, the rear screw rod having a same central axis as the front screw rod and a screw direction that is opposite to a screw direction of the front screw rod; and a rear nut connected to the rear screw rod and fixed to the rear gripper at an end of the rear nut, and wherein the guide rod penetrates the rear gripper.

7. The charge separating apparatus of claim 1, wherein the gripper comprises:

a first angle charge rod extending in the supply direction and configured to receive driving power from the driver;

a second angle charge rod parallel to the first angle charge rod and spaced apart from the first angle charge rod by a predetermined distance; and a bevel gear rod engaged to the first angle charge rod at a first end and engaged to the second angle charge rod at a second end, and wherein the first angle charge rod and the second angle charge rod are configured to rotate in opposite directions.

8. The charge separating apparatus of claim 1, further comprising a spacer remover configured to remove a spacer from the rear charge at a rear end of the unit of three charges.

9. The charge separating apparatus of claim 8, wherein the spacer remover comprises:

a coupling bar configured to rotate about a first end corresponding to a central axis;

a spacer coupler at a second end of the coupling bar and configured to couple to the spacer; and a separation wall perpendicular to a rotation trajectory of the spacer coupler and comprising an opening through which the coupling bar may pass.

10. A charge separating apparatus comprising:

a transporter configured to move charges in a supply direction;

a door assembly configured to stop a front end of a unit of three charges at a predetermined position, the unit of three charges comprising a combination of a central charge, a front charge, and a rear charge;

a gripper configured to grip each of the central charge, the front charge, and the rear charge;

a separator configured to move the front charge in the supply direction and move the rear charge in a direction that is opposite to the supply direction; and a driver configured to supply driving power to the door assembly, the gripper, and the separator, wherein the driver comprises:

a first driving motor configured to supply driving power to the gripper; and a second driving motor configured to supply driving power to the door assembly and the separator.

11. The charge separating apparatus of claim 10, wherein the gripper comprises:

a first angle charge rod extending in the supply direction;

a power transmission gripping gear fixed to the first angle charge rod and configured to receive driving power from the first driving motor;

a power transmission bevel gear fixed to an end of the first angle charge rod;

a second angle charge rod parallel to the first angle charge rod and spaced apart from the first angle charge rod by a predetermined distance;

an angle change bevel gear fixed to an end of the second angle charge rod; and a bevel gear rod engaged with the power transmission bevel gear at a first end and engaged with the angle change bevel gear at a second end.

12. The charge separating apparatus of claim 11, wherein the gripper comprises:

a first gripping arm fixed to the first angle charge rod at an end of the first gripping arm; and a second gripping arm fixed to the second angle charge rod at an end of the second gripping arm, and wherein the first gripping arm and the second gripping arm are configured to move closer to the central charge, the front charge, and the rear charge and away from the central charge, the front charge, and the rear charge based on a rotation of the first angle charge rod and the second angle charge rod.

13. The charge separating apparatus of claim 11, further comprising a spacer remover configured to remove a spacer from the rear charge at a rear end of the unit of three charges.

14. The charge separating apparatus of claim 13, wherein, in a state in which the first driving motor is driven in a first direction, the gripper is configured to grip the central charge, the front charge, and the rear charge, and the spacer remover is configured to move toward the spacer, and wherein, in a state in which the first driving motor is driven in a direction that is opposite to the first direction, the gripper is configured to release a gripping of the central charge, the front charge, and the rear charge, and the spacer remover is configured to remove the spacer from the rear charge.

15. The charge separating apparatus of claim 13, wherein the spacer remover comprises:

a first removal shaft extending in a height direction;

a second removal shaft parallel to the first removal shaft;

a removal bevel gear fixed to an end of the first removal shaft and engaged with the power transmission bevel gear;

a first spur gear fixed to the first removal shaft;

a second spur gear fixed to the second removal shaft and engaged with the first spur gear;

a coupling bar connected to the second removal shaft at a first end of the coupling bar;

a spacer coupler arranged at a second end of the coupling bar and configured to be coupled to the spacer; and a separation wall perpendicular to a rotation trajectory of the spacer coupler and comprising an opening through which the coupling bar may pass.

16. The charge separating apparatus of claim 11, wherein the separator comprises:

a power transmission separation gear configured to receive driving power from the second driving motor;

a front screw rod extending in the supply direction and fixed to the power transmission separation gear at an end of the front screw rod;

a front nut connected to the front screw rod; and a guide rod extending parallel to the supply direction.

17. The charge separating apparatus of claim 16, wherein the gripper further comprises a front gripper configured to grip the front charge, wherein the front gripper comprises a front block configured to accommodate the first angle charge rod, the second angle charge rod, and the guide rod, and wherein the front nut is fixed to the front block.

18. The charge separating apparatus of claim 10, wherein the gripper further comprises a central gripper configured to grip the central charge, and wherein the first driving motor and the second driving motor are fixed to the central gripper.

19. A method performed by a charge separating apparatus comprising a transporter configured to move charges in a supply direction, a door assembly extending in a direction perpendicular to the supply direction, a gripper configured to grip charges, a separator configured to separate charges, and a driver configured to supply driving power to the door assembly, the gripper, and the separator, the method comprising:

moving, by the transporter, charges in a supply direction;

stopping, by the door assembly, a front end of a unit of three charges at a predetermined position, the unit of three charges comprising a combination of a central charge, a front charge, and a rear charge;

gripping, by the gripper, each of the central charge, the front charge, and the rear charge; and by the separator, moving the front charge in the supply direction and moving the rear charge in a direction that is opposite to the supply direction.

20. The method of claim 19, wherein the charge separating apparatus further comprises a spacer remover configured to remove a spacer, and wherein the method further comprises removing a spacer from the rear charge at a rear end of the unit of three charges.

* * * * *